US005760678A

United States Patent [19]

Pavlacka et al.

[11] Patent Number: 5,760,678

[45] Date of Patent: Jun. 2, 1998

[54] MANUAL MODULAR PULL STATION

[75] Inventors: Myron F. Pavlacka, Frankfort, Ill.; Robert L. Rankin, Dublin, Ohio

[73] Assignee: Harrington Signal Incorporated, Moline, Ill.

[21] Appl. No.: 650,636

[22] Filed: May 20, 1996

[51] Int. Cl.[6] ..... G08B 25/00

[52] U.S. Cl. ..... 340/287; 340/289; 340/293; 340/296; 340/301; 340/305; 340/308

[58] Field of Search ..... 340/287, 289, 340/293, 296, 301, 302, 305, 306, 308

[56] References Cited

U.S. PATENT DOCUMENTS

| | | | |
|---|---|---|---|
| 2,506,148 | 5/1950 | Hammerly . | |
| 3,253,272 | 5/1966 | Schuchard et al. . | |
| 3,703,721 | 11/1972 | Goodwater . | |
| 4,017,844 | 4/1977 | Facchini et al. . | |
| 4,107,464 | 8/1978 | Lynch et al. . | |
| 4,162,485 | 7/1979 | Facchini et al. . | |
| 4,267,549 | 5/1981 | Taylor . | |
| 4,506,253 | 3/1985 | Mande et al. . | |
| 4,551,707 | 11/1985 | Simpson . | |
| 4,638,297 | 1/1987 | Roots . | |
| 4,706,065 | 11/1987 | Kovacic et al. . | |
| 4,728,928 | 3/1988 | Shipley . | |
| 5,283,546 | 2/1994 | Scop et al. . | |
| 5,448,031 | 9/1995 | Concannon et al. | 200/331 |

*Primary Examiner*—Jeffery A. Hofsass
*Assistant Examiner*—Nina Tong
*Attorney, Agent, or Firm*—Leydig, Voit & Mayer, Ltd

[57] ABSTRACT

A pull box for an emergency alarm system is disclosed having a modular construction that accommodates one or more optional modules in order to provide a wide variety of possible configurations. Also, the basic design of the pull station provides for its resetting without requiring a cover of the pull station to be open. As part of the optional modules, the pull station may be configured to provide both local and general alarm signals, with the general alarm signal capable of being activated only by authorized personnel.

37 Claims, 18 Drawing Sheets

*Basic Unit: Control Panel Switch with Pullbar Activation*

*Basic Unit plus LED Switch activated by shield*

*Basic Unit plus Voice Module or Piezo Horn Switch activated by shield*

*Institutional Unit plus LED Switch activated by Pullbar*

*Institutional Unit plus Sound Switch activated by Pullbar*

*Institutional Unit plus stacked Sound and LED Switches activated by Pullbar*

*Institutional Unit plus LED Switch activated by Pullbar plus Sound Module Switch activated by shield*

*Institutional Unit plus LED Switch activated by Shield plus Sound Module Switch activated by Pullbar*

MANUAL MODULAR PULL STATION

TECHNICAL FIELD

The invention is generally related to emergency alarm systems and more specifically directed to distributed manually operable switches for activating the system.

BACKGROUND

Emergency alarm systems in public buildings often include manually operable switches placed throughout the building and connected to a wiring system that communicates actuation of the switches to circuitry in a control panel. These alarm systems include evacuation, tornado and fire alarm systems for commercial, industrial, municipal buildings and the like. In conventional systems of these types, activation of one or more of these switches causes the circuitry in the control panel to activate sound generators, which generate an audible alarm.

Over the years, these switches, which are commonly referred to as pull boxes or pull stations, have developed certain common characteristics. For example, pull stations typically are reset after being activated by unlocking a front panel of the station, which releases the switch from its activated position. Once the switch is released and returned to its armed position, the panel is closed and locked. Unlocking the front panel often exposes the switch mechanism and related circuitry, which places the pull station at risk of being damaged. It is also typical for the housings of pull stations to have terminal blocks mounted to the back plates of the housing, which require special utility boxes for mounting the stations to a wall surface.

Conventional pull stations are typically designed to have dedicated features, meaning that a station does not accommodate adding or removing features without redesigning the station. This inflexibility results in systems employing a single design or type of pull station throughout a building even though some areas of the building may be best served by pull stations having features different from those of pull stations in other areas. For example, some areas of the building are remote from most daily activity or primarily occupied by children. In these areas, the pull stations may be at higher risk to false activation than are the pull stations in other areas of the building. Thus, a pull station with a security feature may be desired for some areas of a building but not all areas. Employing different pull stations in a single alarm system, however, may lead to compatibility problems.

SUMMARY OF THE INVENTION

The general aim of the invention is to provide a pull station whose features can be customized for the needs of different environments served by a common alarm system while maintaining the compatibility of all the pull stations with the common system.

A particular object of the invention is to provide a pull station that can be reset without exposing the switch mechanism of the station.

Still another object of the invention is to provide a pull station having the foregoing basic features that can be customized to incorporate optional features as identified below without requiring retooling of the housing for the pull station.

It is a still further object of the invention to provide a pull station with the foregoing features and having an optional feature for sequentially generating a local alarm followed by a general alarm, with the general alarm generated only after supervisory personnel have confirmed the local alarm is genuine.

It is still another object of the invention to provide a pull station having an optional feature for warning a person intending to activate a pull box that activation will generate an alarm signal.

Yet another object of the invention is to provide a pull station having an optional feature for allowing easier activation by children or wheelchair-bound persons.

Other objects and advantages will become apparent upon reference to the following detailed description when taken in conjunction with the drawings.

To achieve the foregoing objects and others, there is provided a pull station for activating an alarm system that includes (1) a manually actuated assembly having armed and activated positions for opening and closing a switch in the alarm system and (2) a mechanism accessible from an external surface of the housing for resetting the switch and returning the assembly from the activated position to the armed position without opening the housing. In the illustrated embodiment of the invention, the mechanism also releases a coupling between a cover and back plate of the housing in order to provide access to the interior of the pull station. Specifically, in the illustrated embodiment the mechanism is a lock that is freed to turn in clockwise and counterclockwise directions when a key is inserted into the lock, which is accessible from the cover of the pull station. Rotation of the lock with the key in one direction (e.g., clockwise direction) releases the manually actuated assembly so that it returns to its armed position. Rotation of the lock and key in the opposite direction (e.g., in a counterclockwise direction), unlocks the cover from a back plate of the housing.

The pull station of the invention accommodates a number of optional modules that implement emergency warning features. For example, a voice module can be added to the basic features of the pull station during assembly or retrofitted to the pull station thereafter. Non-electrical optional modules can also be added to the basic pull station to provide optional features such as a security mechanism that requires a two-part activation of the pull station before the alarm system is activated, wherein the second part of the activation can only be accomplished by authorized personnel. To accommodate optional modules, the housing of the pull station is constructed to include receptacles that mate with and fasten to complementary portions of the optional modules. Preferably, the fastener joining the receptacle and one of the modules is a snap-fit fastener.

One of the optional modules provides for sequential activation of first and second switches, where the first switch controls a local alarm circuit and the second switch controls a general alarm circuit whose signal extends beyond that of the local alarm circuit. Another optional module of the pull station is a shield that is pivotably mounted to the housing of the pull station and controls a switch housed in the pull station for controlling a local alarm circuit. In operation, the shield covers a pull bar of the manually actuated assembly, which is coupled to a switch that controls the general alarm circuit. In order to activate the general alarm circuit, the shield must be pivoted open in order to access the pull bar. When the shield is opened, the switch controlling the local alarm circuit is activated and the local alarm signal is generated.

BRIEF DESCRIPTION OF THE DRAWINGS

FIGS. 7A–7C are perspective views of one of the microswitches schematically illustrated in FIG. 6, including a stackable module for retaining the switch and mating it, using a snap-fit coupling, to the back panel of the pull station's housing;

While the invention will be described in connection with a preferred embodiment, there is no intention to limit it to that embodiment. On the contrary, the intention is to cover all alternatives, modifications and equivalents falling within the spirit and scope of the invention as defined by the appended claims.

BRIEF DESCRIPTION OF THE PREFERRED EMBODIMENT

Figure 1A:
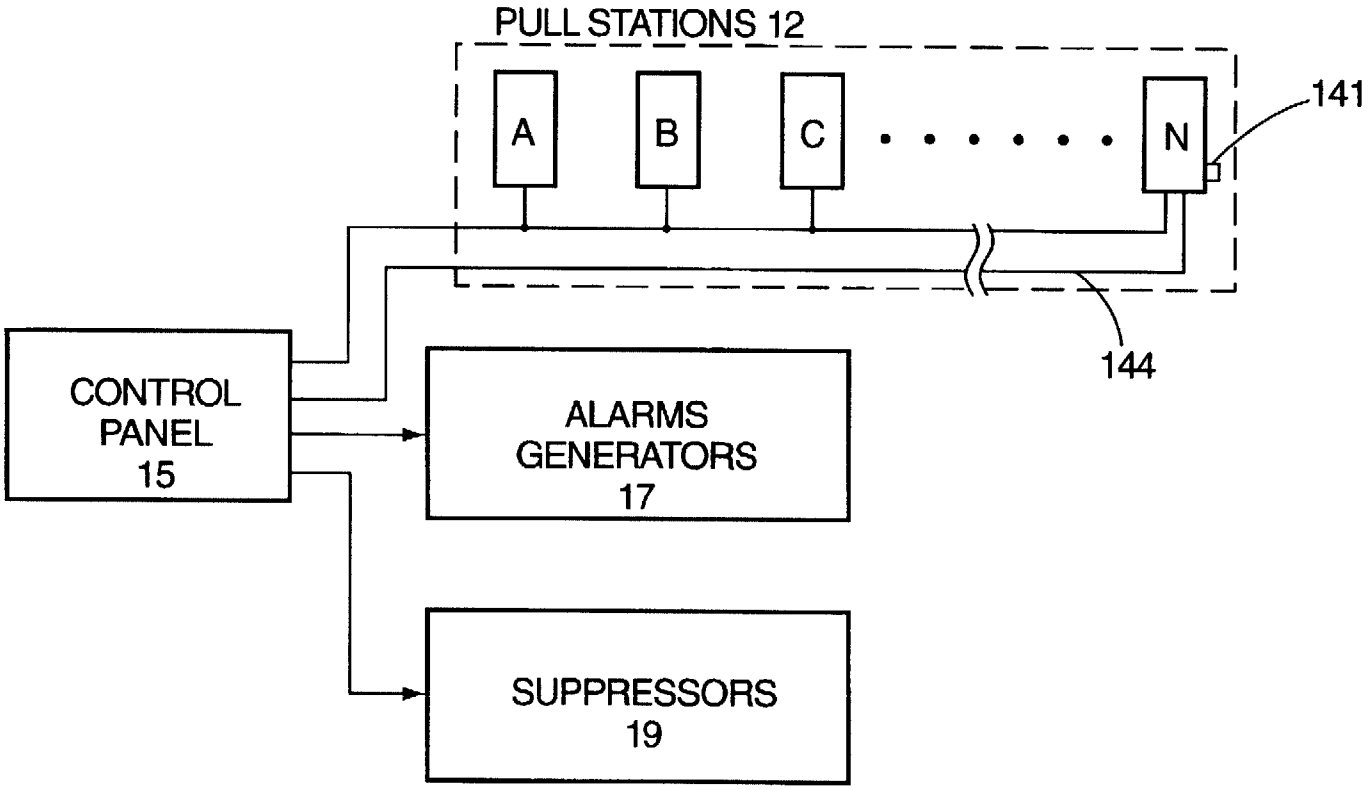
FIGS. 1A and 1B are schematic block diagrams each illustrating an alarm system having plurality of pull stations according to the invention distributed throughout zones of a building for the purpose of providing remote activation of the alarm system and for providing an indication at the control panel of the area of the building in which the alarm was initiated.

Turning first to FIG. 1A, an alarm system 11 for a building typically includes a plurality of pull stations 12A through 12N distributed throughout the building. In most alarm systems, activation of any one of the pull stations 12A through 12N causes a control panel 15 to generate a general alarm throughout the building by delivering drive signals to a plurality of alarm generators 17, which are also distributed throughout the building. In some alarm systems, each of the pull stations 12A–12N is associated with a subset of the alarm generators 17 so that the building is divided into zones. With such an architecture, the control panel 15 may be designed, or programmed if it is microprocessor based, to generate an alarm only in the zone of the pull stations 12A–12N that is activated. The control panel 15 may also be designed or programmed to respond to the activation of one of the pull stations 12A–12N by controlling fire suppressers 19, which are also distributed throughout the building and may be associated with the pull stations and alarm generators to define zones.

In order to activate the alarm system of FIG. 1A, a movable assembly of one of the pull stations 12A–12N is manually moved from an armed position to an activated position. In its activated position, the assembly of the pull station 12 closes a switch mechanism that completes a circuit monitored by the control panel 15 of the alarm system. In a conventional manner, the control panel 15 responds to the closed circuit by activating the alarm generators 17. The control panel 15 may also respond to a closed circuit by activating suppressers 19, which discharge water or some other type of fire retardant.

In accordance with an important aspect of the invention, the manual assembly of one or more of the pull stations 12A–12N sequentially activates a local alarm circuit followed by a general alarm circuit. The local alarm circuit provides a visual or audible alarm signal to the immediately ambient area of the pull station 12 in response to manual activation of the assembly. A further manual movement of the assembly, preferably executable only by authorized personnel, closes the switch mechanism monitored by the control panel 15, which activates the general alarm circuit.

Figure 1B:
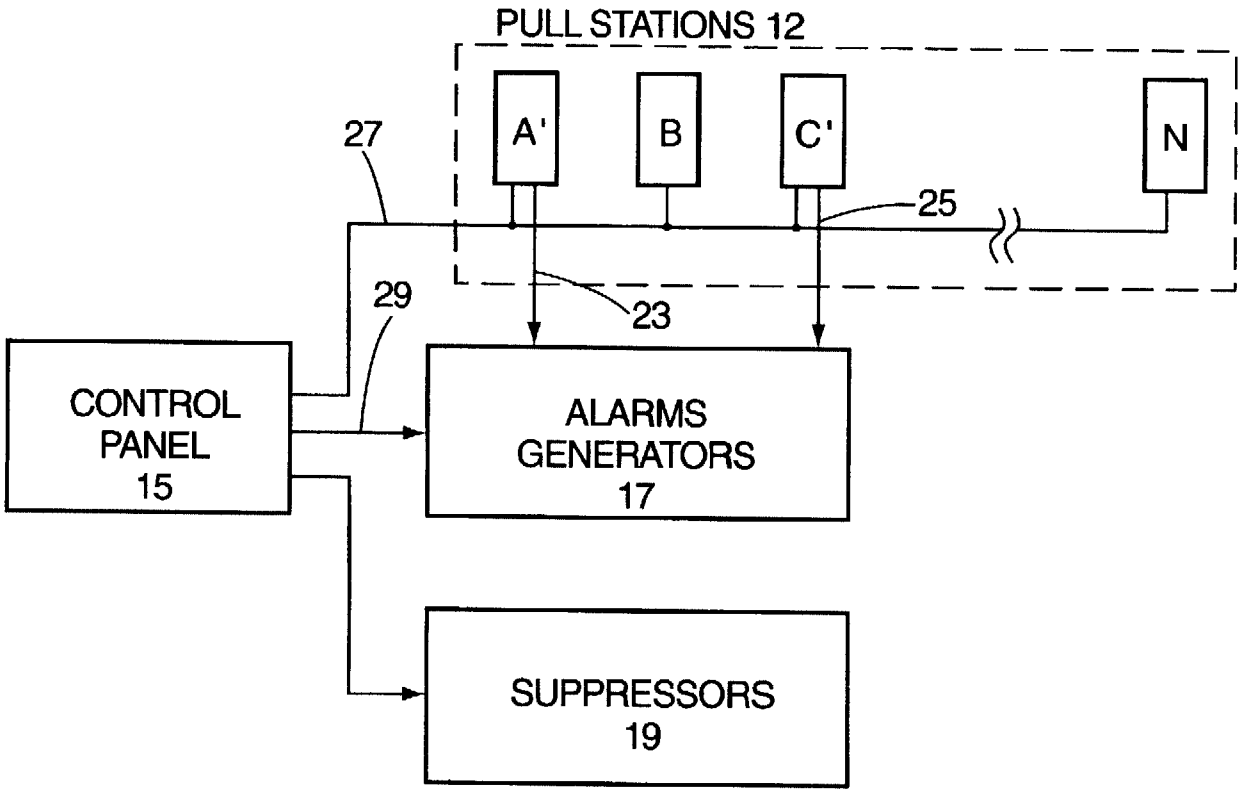

Referring to FIG. 1B, the alarm system illustrated in FIG. 1A has been modified to incorporate pull stations in accordance with the foregoing aspect of the invention. Specifically, each of pull stations 12A' and 12C' includes a manually movable assembly for sequentially activating a local alarm circuit followed by the general alarm circuit controlled by the control panel 15. Manual activation of the assembly of either pull station 12A' or 12C' energizes a local alarm generator that is schematically illustrated as part of the alarm generators 21. Although the local alarm generator may be external to the pull station 12A' or 12C', the preferred embodiment of the invention incorporates the alarm generators for the local alarm circuit into the housing of the pull stations 12A' and 12C'.

In the schematic illustration of FIG. 1B, lead lines 23 and 25 indicate activation of local alarm generators within alarm generator 21 in response to actuation of a first switch. Upon closure of the second switch (i.e., the switch monitored by the control panel 15), a general alarm circuit is activated, which includes line 27 connecting the pull stations 12A', 12B, 12C' and 12D–12N to the control panel 15. Specifically, closure of the second switch at either pull station 12A' or 12C' provides a signal to the control panel 15, which in turn provides drive signals to the alarm generators 21 on line 29, which is also part of the general alarm circuit. Like FIG. 1A, the alarm system of FIG. 1B includes suppressors 19 under the control of the control panel 15. Those skilled in the art will appreciate that both the first and second switches may be monitored by the control panel 15 for controlling both the local and general alarm circuits.

In keeping with the invention, each of the pull stations 12A' and 12C' in FIG. 1B includes a security mechanism that allows the second switch of the pull station to only be activated by qualified personnel. After the manually movable assembly activates the first switch and the local alarm circuit is activated, further movement of the assembly is inhibited by a keyed security mechanism. Authorized personnel using the appropriate keying device may move the security mechanism and free the assembly to activate the second switch, which energizes the general alarm circuit.

As explained in greater detail hereinafter, the keying device is preferably a lock with a tumbler for receiving a mechanical key that frees the lock to rotate. It will be appreciated by those familiar with security locks, however, that both the mechanical and electrical locking devices may be employed as the security mechanism in keeping with the invention. For example, the second switch may be a solid state switch responsive to an input from a keypad either mounted to the housing or connected to it by way of a port on the housing. In a further alternative, authorized personnel are provided with a security card imbedded with an appropriate RF transponder containing a code that is read by an RF receiver within the pull station when the card is held close to the housing of the pull station.

Figure 2:
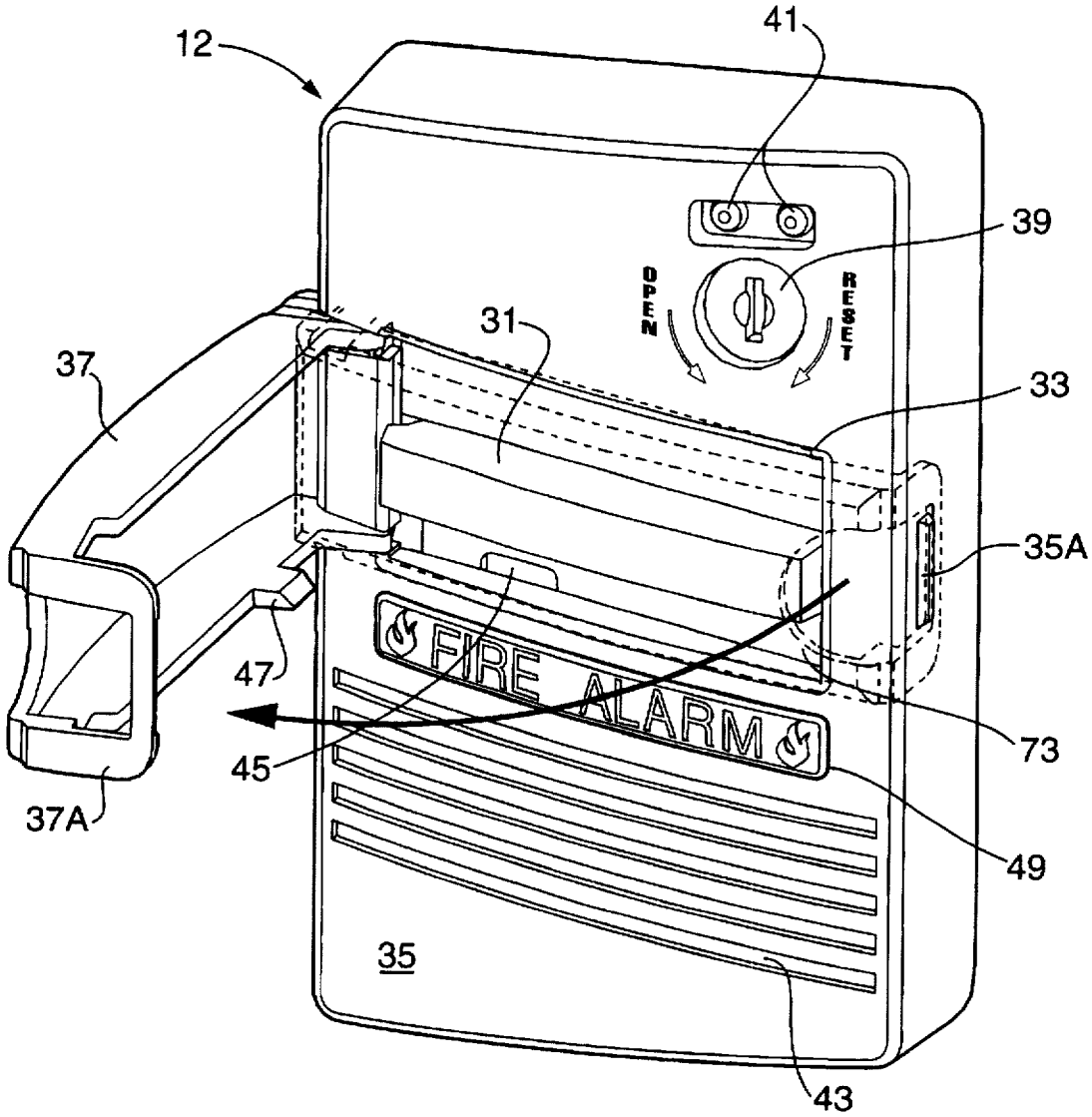
FIG. 2 is a perspective view of a pull station in accordance with the invention, showing a protective shield pivoted open from a closed position (phantom line) to expose a pull bar for activating the fire alarm system.
Figure 3:
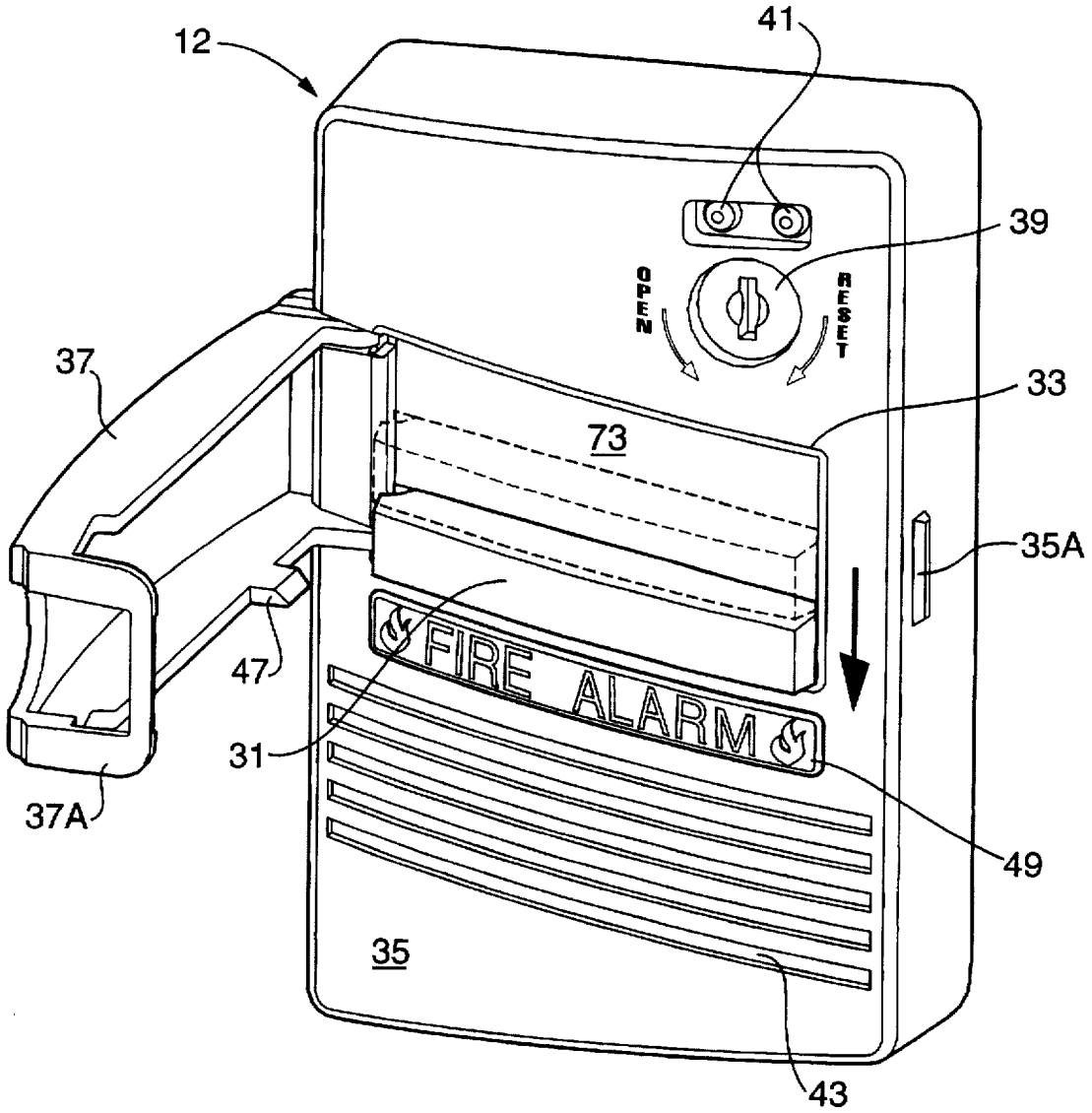
FIG. 3 is the same perspective view of the pull station of FIG. 2 with the pull bar moved from its armed position (phantom line) to its activated position (solid line)
Figure 4:
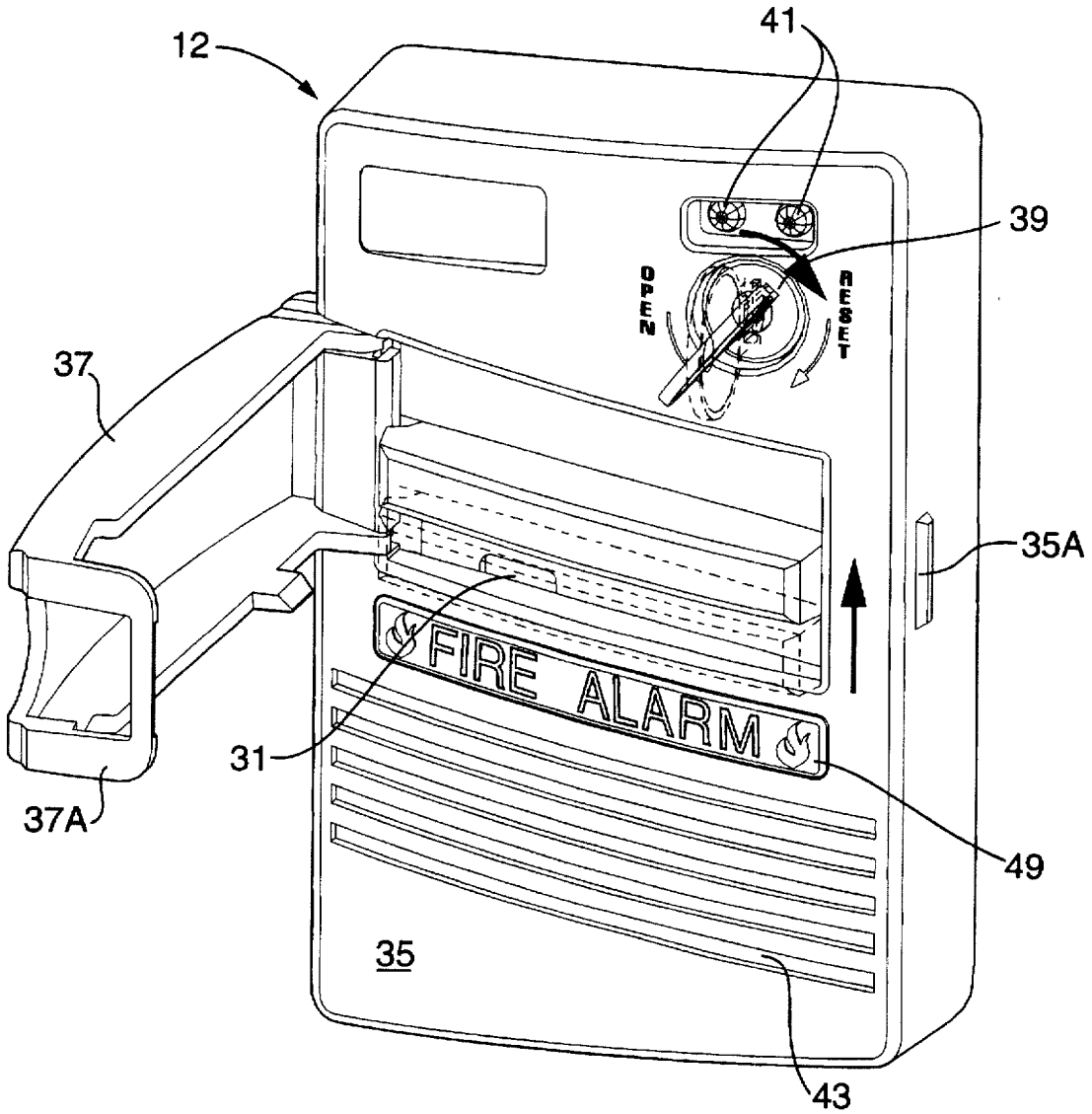
FIG. 4 is the same perspective view of the pull station as shown in FIGS. 2 and 3, with a key inserted and turned in a lock accessible on a cover of the pull station for returning the pull bar from its activated position to its armed position.

FIGS. 2–4 illustrate one of the pull stations 12A–12N of FIGS. 1A or 1B. The following detailed description of one of the pull stations 12A–12N of FIG. 1A or 1B is referenced hereinafter simply by the reference no. 12. A manually movable assembly of the pull station 12 for actuating the switches of the alarm circuits includes a pull bar 31 that is accessible for manual activation through a window 33 of a housing. In order to provide an ergonomic grip for the right hand, the pull bar 31 is angled at approximately 11 degrees to match the natural curl of the right hand. Accordingly, the opening or window 33 of the housing has upper and lower sides that are angled at 11 degrees.

The pull station 12 in FIGS. 2–4 includes a shield 37 pivotably mounted to the housing 35 for movement between closed (illustrated in phantom) and opened positions as shown in FIGS. 2–4. In its closed position, a notch (not shown) in a side arm 37A of the shield 37 receives a rib 35A formed in a side of the housing 35. The rib 35A and the notch form a closure for retaining the shield 37 in its closed position. In order to access the pull bar 31, a user first uses his/her fingers to release a snap-fit engagement formed between the notch and the rib 35A. In this regard, the user bends the side arm 37A outwardly in order to release the rib 35A from the notch. As will be appreciated in those skilled in the art, the bending of the side arm 37A is maintained within its elastic limit in accordance with conventional snap-fit fasteners of this type. With the shield 37 pivoted into its open position as illustrated in FIGS. 2–4, the pull bar 31 is exposed and accessible. As best illustrated in FIG. 3, the pull bar 31 is moved downwardly from an armed position (shown in FIG. 2 and in phantom in FIG. 3) to an actuated position (shown in FIG. 3).

In the embodiment of the invention discussed above in connection with FIG. 1B and pull stations 12A' and 12C', movement of the pull bar 31 from its armed position to its actuated position causes a first switch to become activated and sound a local alarm. In order for the general alarm circuit to sound an alarm, a second switch is actuated by rotation of a lock 39 shown in FIGS. 2–4. This embodiment will be discussed in greater detail hereinafter in connection with FIGS. 9A–9D. In an alternative embodiment, movement of the pull bar 31 of the movable assembly from its armed position to its activated position caused the general alarm circuit to sound as will be appreciated from the more detailed description of the manually movable assembly set forth hereinafter.

Other features of the invention shown in the illustration of FIGS. 2–4 that are discussed in greater detail hereinafter are a display of light emitting diodes (LEDs) 41, a grill 43 for communicating sound and a notch 45 in the movable assembly that mates with a projecting wedge 47 formed in the shield 37. The notch 45 and wedge 47 cooperate to automatically open the shield in accordance with an alternative embodiment also discussed hereinafter. Finally, the housing 35 includes a recessed area for receiving a legend plate 49, which in the illustrations of FIGS. 2–4 is labeled "FIRE ALARM." In keeping with the invention, however, alternative legend plates can be substituted to reflect different types of alarm systems in which the pull station 12 may be used—e.g., "EMERGENCY ALARM" and "EVACUATION ALARM." Moreover, in appropriate situations, legend plates with raised dots for braille can be used. As an alternative, braille may be added to the housing at an area immediately below the grill 43. The shield 37 may also include braille.

In accordance with another important aspect of the invention, after the pull bar 31 of the pull station 12 is pulled down from its armed position to its activated position as indicated by the downwardly pointing arrow in FIG. 3, it is reset and returned to its armed position by rotation of the lock 39. A key 51 is first inserted into the lock, which is accessible from the housing 35 of the station 12. The key 51 frees the lock 39 to rotate. In the illustrated embodiment as best seen in FIG. 4, clockwise rotation of the key 51 and the lock 39 withdraws a valve (not shown) from a spring-biased position that prevents the pull bar 31 from returning to its armed position. When the valve is withdrawn, a spring under tension draws the pull bar 31 back to its armed position as indicated by the arrow in FIG. 4. The key 51 is then rotated counterclockwise back to its original position illustrated in phantom line in FIG. 4 and withdrawn, leaving the pull station 12 reset and primed to again activate the alarm system. Thus, the pull station 12 may be reset and primed for future activation of the alarm system without opening the housing 35.

Figure 5:
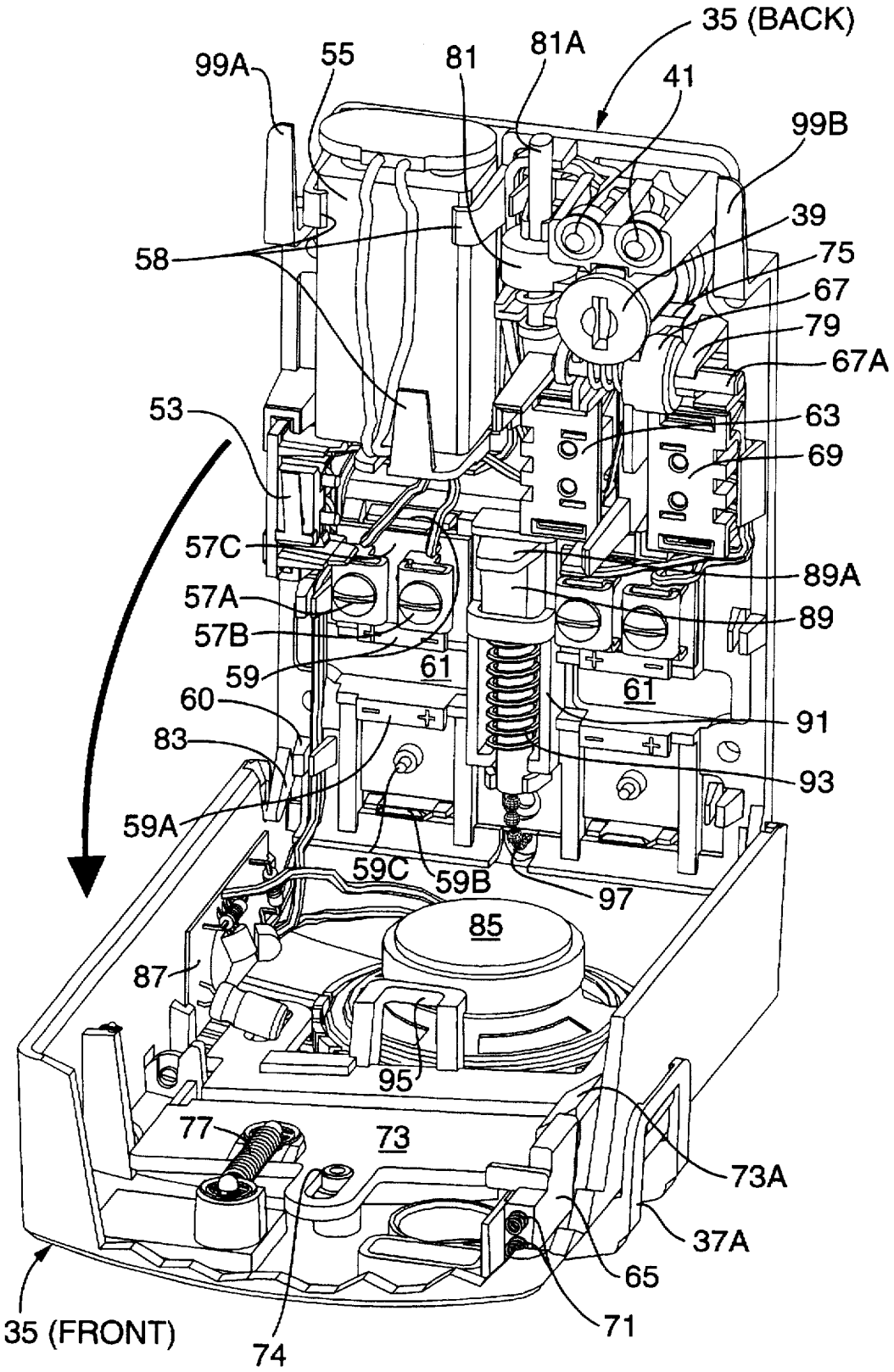
FIG. 5 is the same perspective view of the pull station as shown in FIGS. 2–4 after the key inserted into the lock has been rotated in a counterclockwise direction to release the cover of the housing of the pull station, which exposes the back plate of the housing and the interior mechanisms of the station.

As best shown in FIG. 5, the housing 35 of the pull station 12 includes a cover 35(FRONT) and a back plate 35(BACK) pivotably mated in a clam-shell configuration, which allows the internal mechanisms of the pull station 12 to be easily accessed. In this regard, the lock 39 serves the dual function of resetting the pull bar 31 as described above and also unlocks the cover 35(FRONT) from the back panel 35(BACK) of the housing 35 and frees the cover to pivot downwardly to expose the internal mechanisms of the two sections of the housing.

The cover 35 (FRONT) may be color coded to indicate its function. For example, a fire alarm pull station 12 may have a red color whereas a tornado alarm pull station may have a blue cover. By color coding the pull station 12, the control panel 15 can then be programmed to evaluate the type of emergency based on which color coded pull station was activated and initiate an appropriate response.

In accordance with yet another important aspect of the invention, the interior of the housing 35 includes receptacles for mounting modules for one or more optional features of the pull station 12. The receptacles allow the modules to be easily added during assembly of the pull station 12 or retrofitted thereafter. Preferably, the cover 35(FRONT) and back plate 35(BACK) of the housing 35 are formed of molded plastic, such as polystyrene and polycarbonate. As best illustrated in FIG. 5, the back plate 35(BACK) of the housing 35 is molded to include several receptacles for receiving microswitch assemblies that are held in the receptacles by fasteners forming a snap-fit engagement. In the illustrated embodiment, the fasteners comprise flexible ribs extending from a body of the microswitch assembly that mate with slots in the receiving receptacle as explained in greater detail hereinafter in connection with FIGS. 7 and 8. Other receptacles include flexible ribs that cooperate with modules to fasten the module to the housing 35. Other receptacles comprise several guide surfaces for receiving slidable members of optional modules installed into the pull station 12 as also explained in greater detail hereinafter.

In the embodiment of the pull station 12 illustrated in FIG. 5, several modules for optional features are mounted into their mating receptacles. Specifically, a microswitch assembly 53 is fitted to a mating receptacle in the back panel 35(BACK) and positioned to be in registration with a camming portion of the shield 37 so that the switch 53 is closed and opened in response to the opening of the shield 37. This feature is described in greater detail hereinafter in connection with FIGS. 11A and 11B. After the shield 37 is opened, the activation of the microswitch assembly 53 passes energy to a load from either a battery 55 mounted within the housing or from an external power source connected into the pull station 12 by way of a pair of terminals 57A and 57B. In the pull station 12 of FIG. 5, the load controlled by the microswitch assembly 53 is a voice module comprising a printed circuit board 87 and a speaker 85. Alternatively, the microswitch assembly may control any of the optional modules described hereinafter that require electrical power.

The wiring of each of the modules is captured in a harness comprising a series of strain release receptacles such as the receptacle 60 in FIG. 5. A number of these receptacles are positioned on the back plate 35(BACK) in order to hold in place the wiring of the electrical modules such as the voice module or the LEDs 41.

In keeping with the modular construction of the pull station 12, the battery. 55 as illustrated in FIG. 5 is received by a receptacle 58 formed by resilient arms extending from the interior surface of the back panel 35(BACK). Likewise, a receptacle 59 comprising resilient arms extending from the interior surface of the back panel 35(BACK) mate to a substrate 57C to which the terminals 57A and 57B are mounted. In FIG. 5, the back panel 35(BACK) includes four receptacles 59 for receiving external wiring through a pair of ports 61 in the back panel 35(BACK). The details of one of the receptacles 59 is best illustrated in one of the two lower receptacles 59, which are not mated with terminal pairs 57A and 57B. Each of the receptacles 59 includes opposing flexible ribs or fingers 59A and 59B that fasten the terminals to the housing 35 in a snap-fit engagement. To position the substrate 57C and prevent its lateral movement, a centering post 59A projects into a mating recess or hole in the substrate.

After the shield 37 is open (FIG. 2), the pull bar 31 is moved from its armed position to its actuated position (FIG. 3), which in the embodiment of FIG. 5 activates the microswitch assembly 63. In keeping with the invention, each of the microswitch assemblies 53 and 63 may be part of one of several possible modules for optional features. As explained hereinafter, each of the microswitch assemblies 53 and 63 may control any one of the electrical modules, such as the LEDs 41 or the voice module. In the illustrated embodiment of FIG. 5, the microswitch assembly 63 alternately activates one of two light emitting diodes (LEDs) 41. One of the two LEDs 41 radiates green light and is active when the pull bar 31 is in its armed position. The other one of the pair of LEDs 41 radiates red light and is alternately activated by the microswitch assembly 63 to when the pull bar 31 is in its actuated position.

Further in keeping with the modular construction of the pull station 12, a follower 65 in FIG. 5 follows the movement of the pull bar 31 and blocks a plunger 67 from activating a microswitch assembly 69, which is the switch for activating the general alarm circuit. A pair of springs 71 bias the follower 65 against a camming surface of a plate 73 from which the pull bar 31 is formed. The plate 73 is slidable along slots in the plate that mate with posts 74 projecting from the interior of the cover 35(FRONT). A collar 75 fitted about the barrel of lock 39 releases the plunger.67 and frees its spring bias to move the plunger into engagement with the microswitch assembly 69 and activate the general alarm circuit. The collar 75 is fitted about the barrel or body of the lock 39 and includes camming surfaces that engage the follower 65 when the key is rotated in a counterclockwise direction as explained more fully hereinafter in connection with FIGS. 9A–9E. Rotation of the lock 39 and the collar 75 raises the follower 65 against its spring bias provided by springs 71 and frees the plunger 67 to release its spring bias and move into engagement with the microswitch assembly 69.

With the pull station 12 fully activated, a valve 67A of the reciprocating plunger 67 extends over an arm 73A, which is an extension of the plate 73, and prevents the pull bar 31 from returning to its armed position, even though a spring 77 biases the pull bar upwardly. In order to release the plate 73 and allow the spring 77 to draw the pull bar 31 back to its up position, the collar 75 of the lock 39 includes a camming surface that engages the reciprocating or linear plunger 67 when the lock is rotated in a clockwise direction. Rotation of the lock 39 in its clockwise direction withdraws the plunger 67 and its valve 67A from over the top of the arm 73A and frees the plate 73 to return the pull bar 31 to its armed position.

Like the optional modules, the plunger 67 is snap fitted into a receptacle of flexible fingers or ribs 79 in the back panel 35(BACK) of the pull station 12. A second reciprocating or linear plunger 81 is snap fitted into a similar receptacle and is also responsive to a camming surface of the collar 75, but it does not control a microswitch assembly. Instead, the valve 81A of the plunger 81 mates with the cover 35(FRONT) to lock the cover to the back panel 35(BACK). Rotation of the lock 39 in a counterclockwise direction withdraws the valve 81A of the plunger 81 from a mating contact with the cover 35(FRONT) and frees the cover to pivot downwardly as illustrated by the arrow in FIG. 5. Hinge assemblies, one of which is illustrated and indicated by the reference no. 83 in FIG. 5, define a pivot axis between the cover 35(FRONT) and the back panel 35(BAcK).

Several additional modules for optional features are also included in the embodiment shown in FIG. 5. Specifically, the voice module for providing voice messages includes the speaker 85 mounted to the interior of the grill 43 and a printed circuit board 87 fitted in a sliding engagement with a receptacle in the front cover 35(FRONT), which includes voice synthesizing electronics. In the embodiment of FIG. 5, the voice synthesizing electronics is powered by the battery 55 and is activated by the microswitch 53, whereas power to the LEDs 41 is provided from an external source connected through the terminal pairs 57A and 57B.

Yet another module for an optional feature included in the embodiment illustrated in FIG. 5 is a lanyard 89 slidably fitted into a receptacle 91 formed in the back panel 35(BACK). The lanyard 89 is biased upwardly by a spring 93 under compression between upper and lover opposing surfaces of the receptacle 91. The top of the lanyard 89 includes a projecting lip 89A that mates with an outrigger 95 of the plate 73 to form a coupling. This coupling allows downward movement of the lanyard 89, which is responsive to a pulling force applied to a chain 97 coupled to the lanyard, to move to the activated position the plate 73 and the pull bar 31 formed from it. As explained in more detail hereinafter, the notch 45 shown in FIGS. 2–4 kicks out the shield 37 when the lanyard 89 is used to move the pull bar 31 to its activated position.

Finally, the back panel 35(BACK) in FIG. 5 includes two upwardly extending and opposing prongs 99A and 99B. These prongs 99A and 99B mate with complementary ribs in the cover 35(FRONT) and provide a weak spring bias to the cover that is released when the cover is unlocked so that the cover pops away from the back panel, which makes it easier for the cover to be grabbed and pivoted downwardly.

Figure 6:
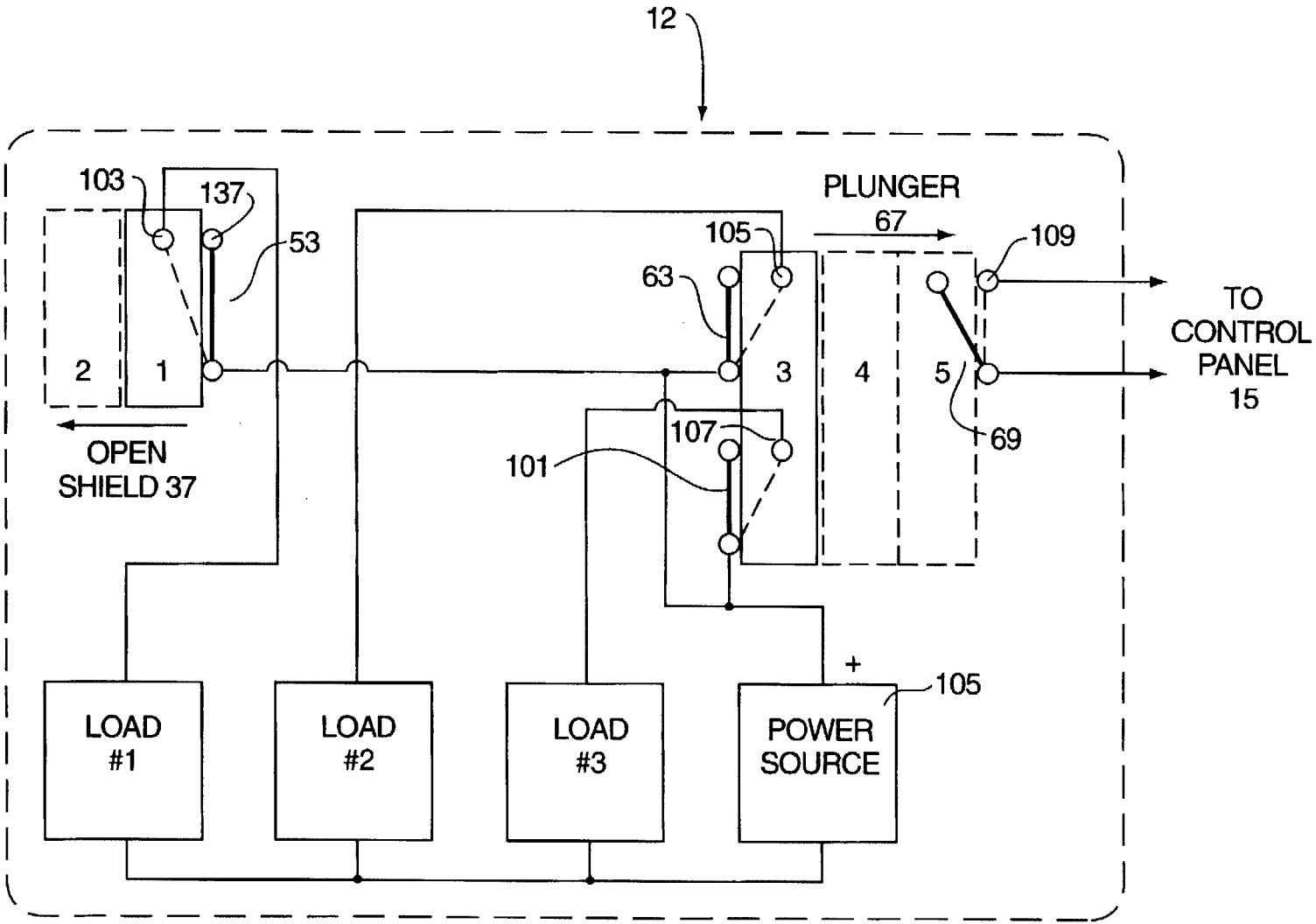
FIG. 6 is a schematic diagram of the circuitry for an embodiment of the pull station of FIGS. 2–5 that incorporates three optional features that are selectively activated by microswitches.

Although not shown in FIG. 5, the switch assemblies are stackable so that a second switch assembly can be piggy-backed onto the switch assembly 63 in FIG. 5. With this additional switch assembly, the pull station 12 includes four switches that are each capable of controlling a function of the pull station 12. FIG. 6 is a high-level electrical schematic of a pull station 12 incorporating the microswitch assemblies 53, 63, 69 and a fourth assembly 101 that is piggy-backed onto the switch assembly 63.

In operation, when the shield 37 is in its closed position, the microswitch assembly 53 is in the position shown in solid line in FIG. 6 and the position of the shield 37 is shown symbolically by the solid rectangle 1. When the shield 37 is opened as illustrated in FIGS. 2–4, the surface of the shield engaging the microswitch 53 moves from the position represented by the solid rectangle 1 to the position symbolized by the dashed rectangle 2. With the shield 37 open, the microswitch assembly 53 closes on contact 103, which connects a power source 105 (e.g., battery 55) to a load 1, which in the embodiment of FIG. 5 is the voice module.

With the shield 37 open, the pull bar 31 is accessible to be moved from its armed position to its actuated position as illustrated in FIGS. 2 and 3. In FIG. 6, as the pull bar 31 moves downwardly, it moves the plunger 67 from position 3 to position 4 illustrated by a dashed rectangle line. With the plunger 67 in the position of rectangle 4, the microswitch assemblies 63 and 101 are freed to close on contacts 105 and 107, respectively. These microswitch assemblies then provide the power from the power source 105 to loads 2 and 3. Each of the loads 1, 2 and 3 is preferably one of the optional features shown in FIGS. 13A, 13B and 13C.

The plunger 67 moves from position 4 to position 5 as shown symbolically in FIG. 6 after the lock 39 has been rotated to raise the follower 65 as described above and hereafter in connection with FIGS. 9A–9E. With the plunger 67 in position 5, the microswitch assembly 69 closes on contact 109, which energizes the system alarm circuit. In contrast, closure of the switch assemblies 53, 63 and 101 on contacts 103, 105 and 107 respectively energizes a local alarm circuit realized by one or more of the loads 1, 2 and 3.

Figures 7, 8:
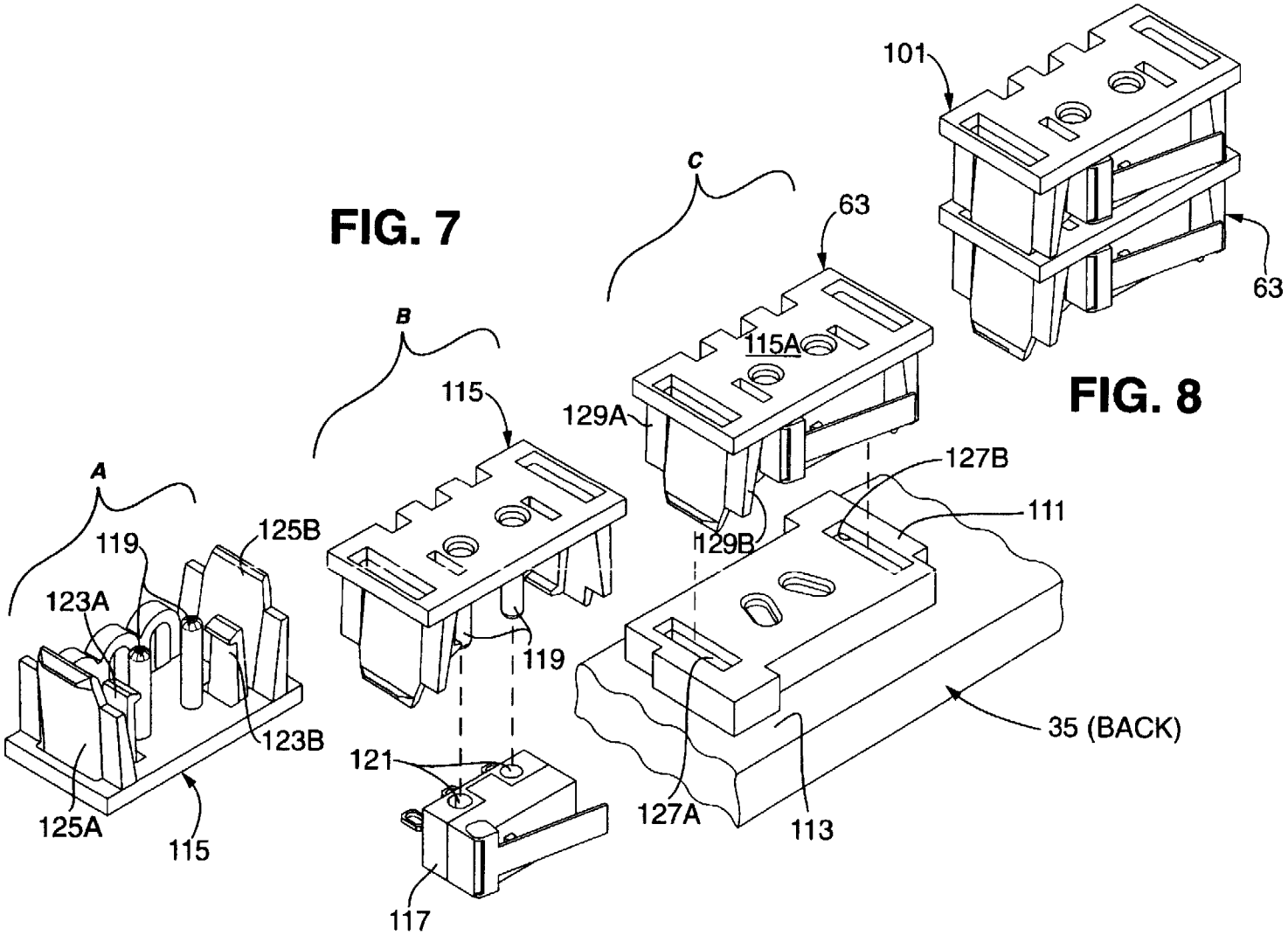
FIG. 8 is a perspective view of a pair of the microswitches and the modules illustrated in FIGS. 7A–7D in a stacked arrangement to provide for their mutual activation in response to the same mechanical motion.

FIG. 7 illustrates microswitch assembly 63, its component parts and its mating to a receptacle 111 formed on the interior surface 113 of the back panel 35(BACK). It will be appreciated that each of the other microswitch assemblies 53, 69 and 101 is identical to the microswitch assembly 63 illustrated in FIG. 7 and described hereinafter.

As illustrated in FIG. 7, the microswitch assembly 63 comprises a cradle 115 that receives a microswitch 117. Alignment pins 119 in the cradle 115 are received by bores 121 in the .microswitch 117 in order to provide a registration between the cradle and the microswitch, as can be best seen in FIG.7B.

Opposing flexible arms 123A and 123B each includes a finger extending inwardly toward the other arm as best illustrated in FIG. 7A. As the microswitch 117 is received by the cradle 115, the sides of the switch contact the fingers of the arms 123A and 123B, causing the arms to bend outwardly. When the microswitch 117 is fully received onto the pins 119, the fingers of the arms 123A and 123B are extending above the body of the microswitch 117, which frees the arms to snap inwardly and bring the fingers over the top of the body. Thus, the microswitch 117 is fastened to the cradle by a snap-fit engagement provided by the arms 123A and 123B.

After the microswitch 117 and cradle 115 are fastened to form the microswitch assembly 63 (FIG. 7C), a second pair of flexible arms 125A and 125B of the cradle 115 positioned outboard of the flexible arms 123A and 123B are aligned with and fitted into slots 127A and 127B of the receptacle 111 as illustrated in FIG. 7C. The flexible arms 125A and 125B flex outwardly as the microswitch assembly 63 is joined to the receptacle 111, outwardly extending fingers at the ends of the arms 125A and 125B snap over lower edges of the slots 127A and 127B when a pair of ribs 129A and 129B integral with the arms 125A and 125B contact the surface of the receptacle 111.

FIG. 8 illustrates the microswitch assembly 101 piggy-backed onto the microswitch assembly 63. As can be seen in FIGS. 7B and 7C, the cradle 115 includes a base portion 115A that comprises slots of the same type and position as the slots 127A and 127B of the receptacle 111. Thus, the cradle 115 enables the microswitch assemblies to be stacked so that a single mechanical motion activates both of the switches as can be easily appreciated from the illustration of the stacked microswitch assembles 63 and 101 in FIG. 8.

Referring now to the drawings of FIGS. 9A through 9E, an assembly is illustrated for manually actuating the microswitch assembly 69 of the general alarm circuit.

Although this assembly includes the follower 65 so that the plunger 67 moves through three sequential positions in activating the microswitch assembly 69 as explained hereinafter, an alternative assembly without the follower 65 provides for the plunger 67 to move only through two positions in actuating the microswitch assembly 69 (see FIGS. 14A–14C). Either assembly for actuating the microswitch assembly 69 is in keeping with the present invention.

Figure 9A:
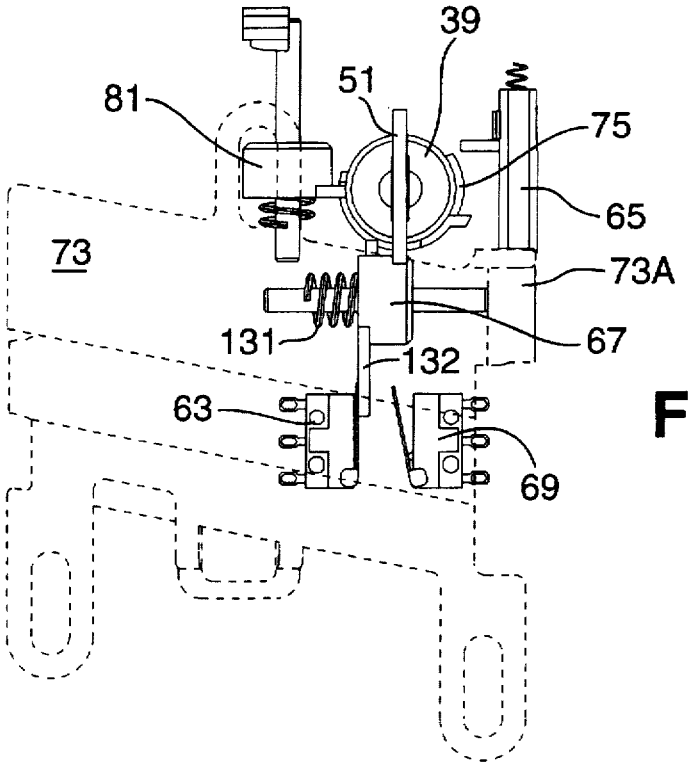
FIGS. 9A–9E are each an isolated view of the pull bar of the pull station and a switch assembly responsive to the movement of the bar, showing movement of the bar and the assembly as a sequence of events leading to activation of the alarm system and subsequent resetting of the pull station incorporating an optional supervisory feature.

In FIG. 9A, the assembly comprises the plunger 67 and the mechanisms that control its movement; namely, the plate 73 (shown in phantom), the lock 39 and the collar 75. In its initial position, the assembly is as illustrated in FIG. 9A. Specifically, the arm 73A of the plate 73 engages a distal end of the reciprocating plunger 67 to tension a biasing spring 131 of the plunger and to bring a flange 132 of the plunger into engagement with the microswitch assembly 63. With the microswitch assembly 63 in the position shown in the position in FIG. 9A, the green LED 41 in FIG. 5 is active and the red LED 41 is turned off.

Figure 9B:
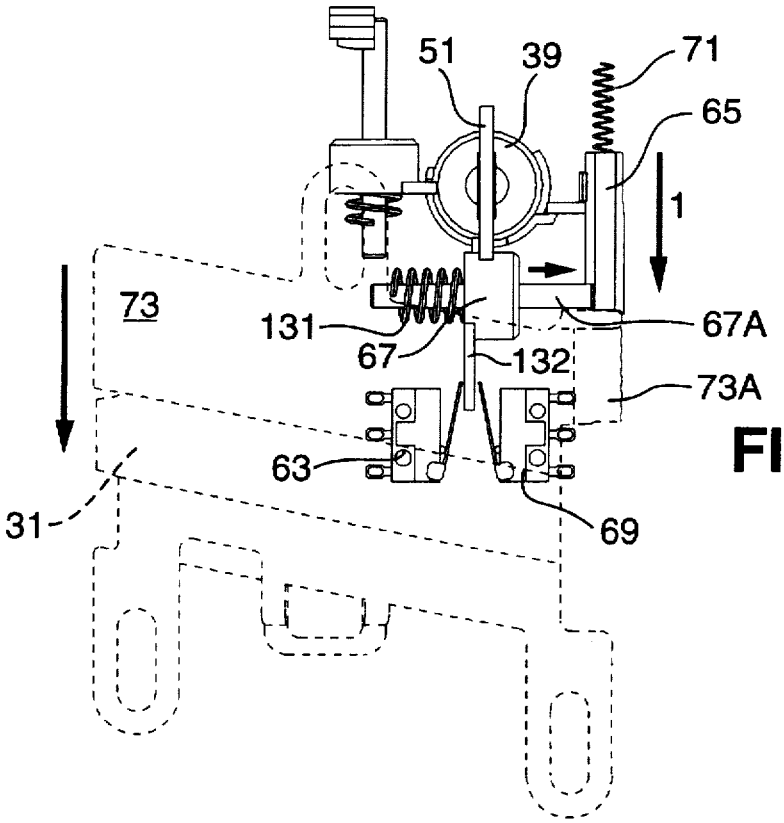

When the pull bar 31 is pulled downwardly as indicated by direction arrow 1 in FIG. 9B, the follower 65 follows the downward movement of the plate 73 as the tension in the springs 71 is released. The valve 67A of the plunger 67 moves to the right in FIG. 9B as indicated by the direction arrow 2 and releases part of the tension in spring 131. The distal end of the valve 67A contacts the surface of the follower 65 with tension remaining in the spring 131. The movement of the plunger 67 releases microswitch assembly 63, causing power to be removed from the green LED 41 and applied to the red LED. In keeping with the invention, the microswitch assembly 63 may alternatively control the speaker 85 or any other optional module snap-fitted into the pull station 12.

In order to actuate the general alarm circuit, the key 51 is inserted into the lock 39 in order to release it for rotation. With the key 51 inserted, the lock 39 is free to rotate counterclockwise as indicated by the directional arrow 1 in FIG. 9C. The counterclockwise rotation of the lock 39 rotates the collar 75 and brings a radially extending finger of the collar into a camming engagement with a flange 65A extending from the follower 65. Further counterclockwise rotation of the lock 39 moves the follower 65 upwardly as indicated by the directional arrow 2 in FIG. 9C. Once the follower 65 has been moved upwardly by a distance greater than the thickness of the valve 67A, the plunger 67 is free to move to the right in FIG. 9C as indicated by arrow 3 and release further tension from the spring 131. The distal end of the valve 67A engages an inner side wall of the housing 35 and extends over the top of the arm 73A of the plate 73, which prevents the pull bar 31 from being raised back to its armed position. In its position in FIG. 9C, the plunger 67 activates the switch 69, which in turn actuates the general alarm circuit.

Figure 9C:
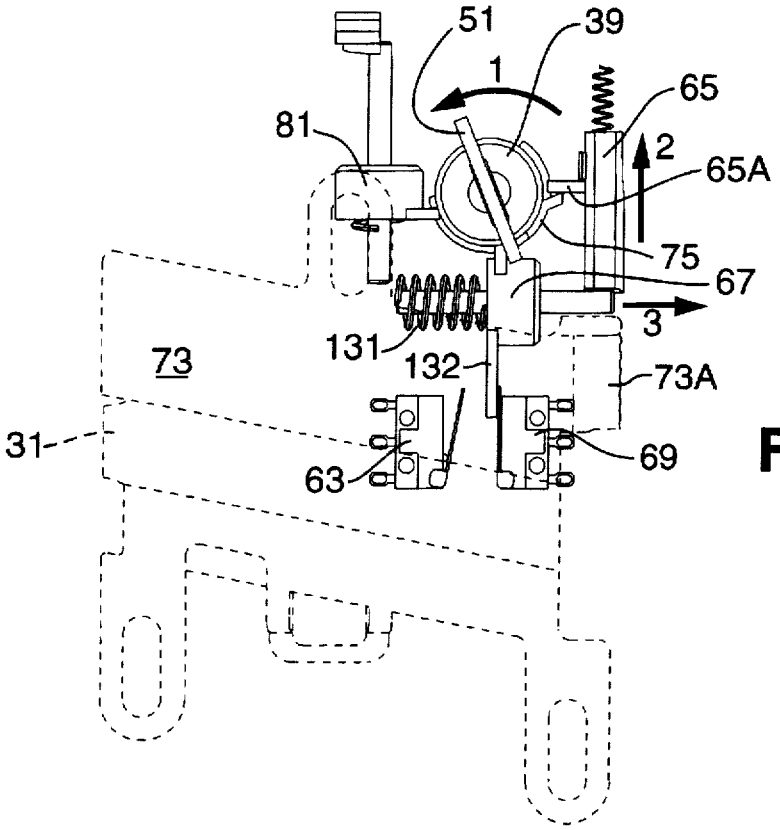
Figure 9D:
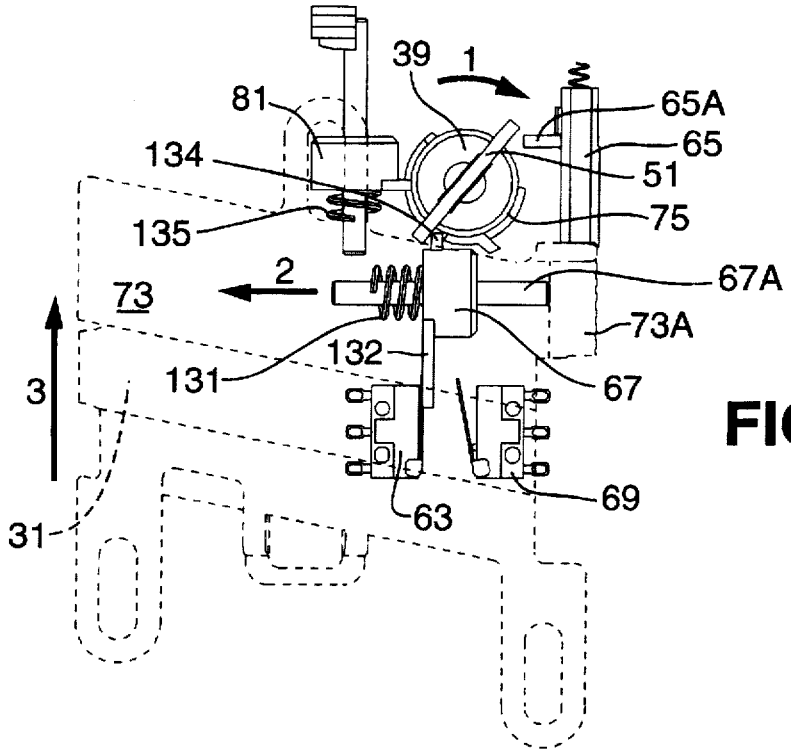

In order to reset the assembly of FIG. 9C, the lock 39 is rotated in a clockwise direction as indicated by the directional arrow 1 in FIG. 9D. This clockwise rotation of the lock 39 rotates the collar 75 and brings a finger of the collar into contact with a flange 134 of the plunger 67 extending upwardly toward the collar. As the finger of the collar 75 engages the flange 134 of the plunger 67 and continues a clockwise rotation, the plunger is moved to the left in FIG. 9D as indicated by the directional arrow 2. Movement of the plunger 67 to the left in FIG. 9D withdraws the valve 67A from above the arm 73A of the plate 73, which frees the plate to release tension in the spring 77 (FIG. 5) and move upwardly as indicated by directional arrow 3 in FIG. 9D. Thus, the assembly is now reset to its armed position.

Figure 9E:
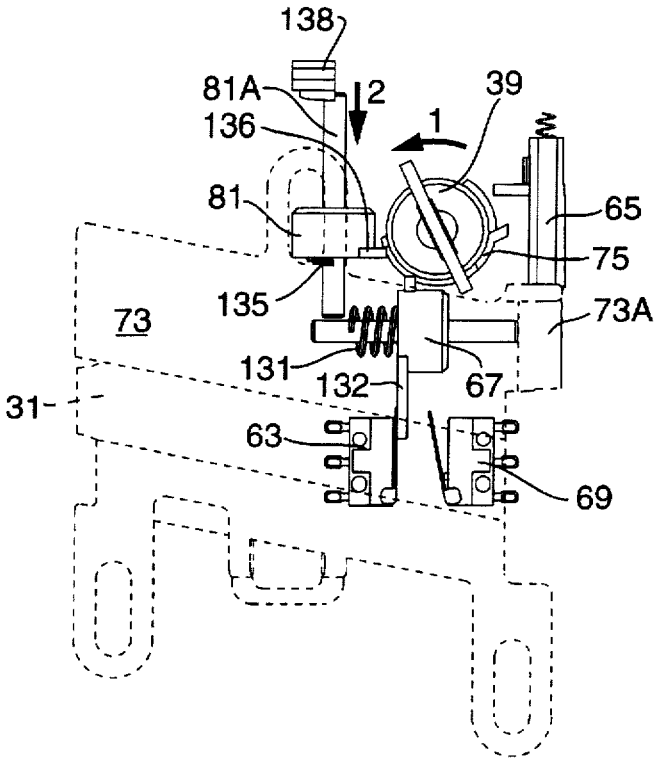
Figure 10A:
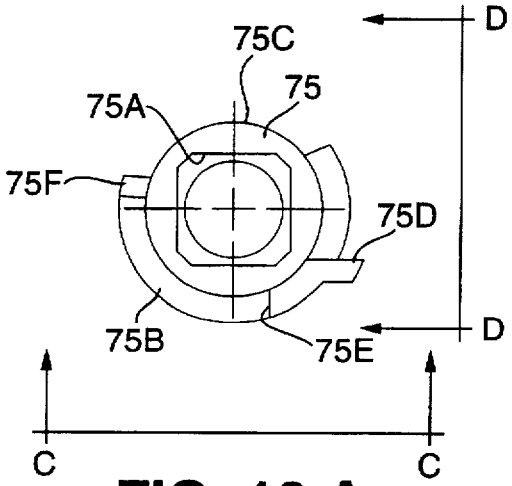
FIGS. 10A–10D are isolated views of a cam in the switch assembly illustrated in FIGS. 9A–9E that is collar-fitted over a rotatable lock for actuating linear plungers of the switch assembly.
Figure 10B:
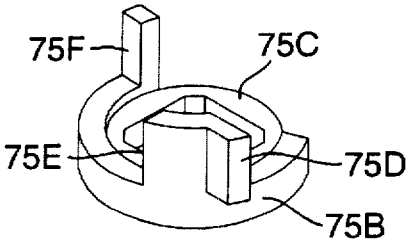
Figure 10C:
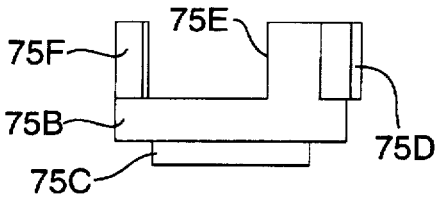
Figure 10D:
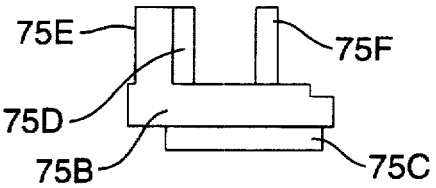

In order to open the cover 35(FRONT), the lock 39 is rotated in a counterclockwise direction as indicated in FIG. 9E by the directional arrow 1. The lock 39 is rotated past the counterclockwise position illustrated in FIG. 9C to a position wherein yet another finger of the collar 75 engages a flange 136 of the plunger 81 and draws the valve 81A of the plunger downwardly and free of a lip 138 of the cover 35(FRONT). With the plunger 81 pulled downwardly as indicated by the directional arrow 2 in FIG. 9E, a spring 135 is placed under tension. When the valve 81A moves free of the lip, the cover 35(FRONT) pops open to release the tension from the fingers 99A and 99B (FIG. 5). The cover 35(FRONT) is closed by again turning the lock 39 in a counterclockwise direction as shown in FIG. 9E, pressing the cover into the fingers 99A and 99B and then releasing the key 51, which allows the tension in the spring 35 to be released. The spring 135 then pushes the valve 81A of the plunger 81 upwardly and into an interference engagement with the lip 138.

The collar 75 fitted over the lock 39 includes three camming surfaces as referenced above and as best illustrated in FIGS. 10(A)–10(D). The collar 75 includes a bore 75A that is approximately rectangular in shape to match the cross-sectional shape of the lock 39. The collar 75 is preferably made of the same material as that of the housing 35. In this regard, the housing 35, the collar 75, the cradle 115 of the microswitch assemblies are all manufactured using conventional injection molding techniques. The three camming surfaces of the collar are supported on an arcuate ridge 75B on the circumference of a circular substrate 75C that includes the bore 75A for receiving the lock 39. The first camming surface 75D engages the follower 65 as described above. The second camming surface 75E engages a tab of the plunger 67 and withdraws the valve 67A from above the arm 73A as described above. Finally, camming surface 75F engages a tab of plunger 81 and draws the plunger downwardly in order to free the valve 81A from the lip 138 of the cover 35(FRONT) as described above.

Figure 11B:
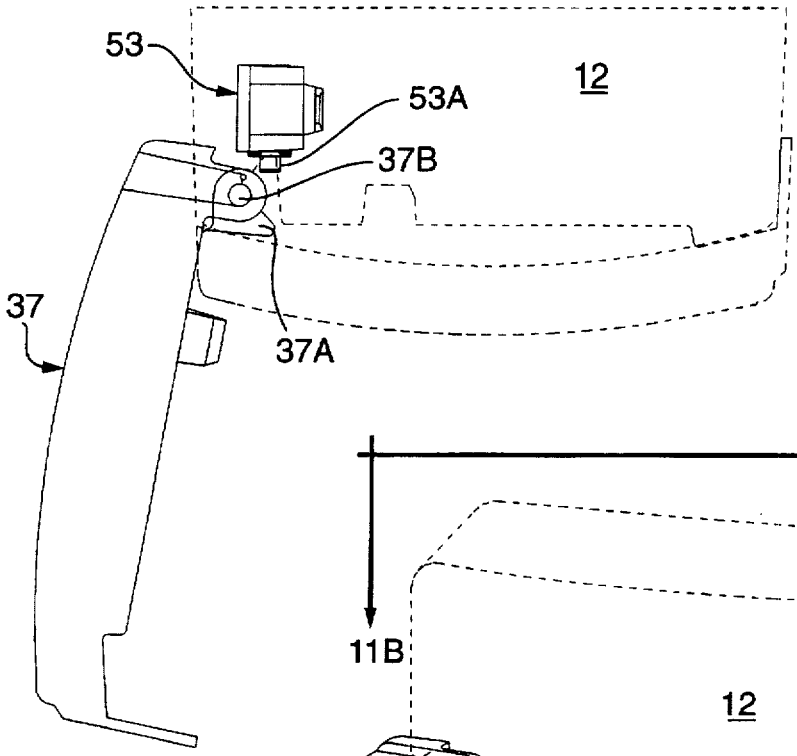
FIG. 11B is a top view of the illustration in FIG. 11A taken along the line 11B–11B.
Figure 11A:
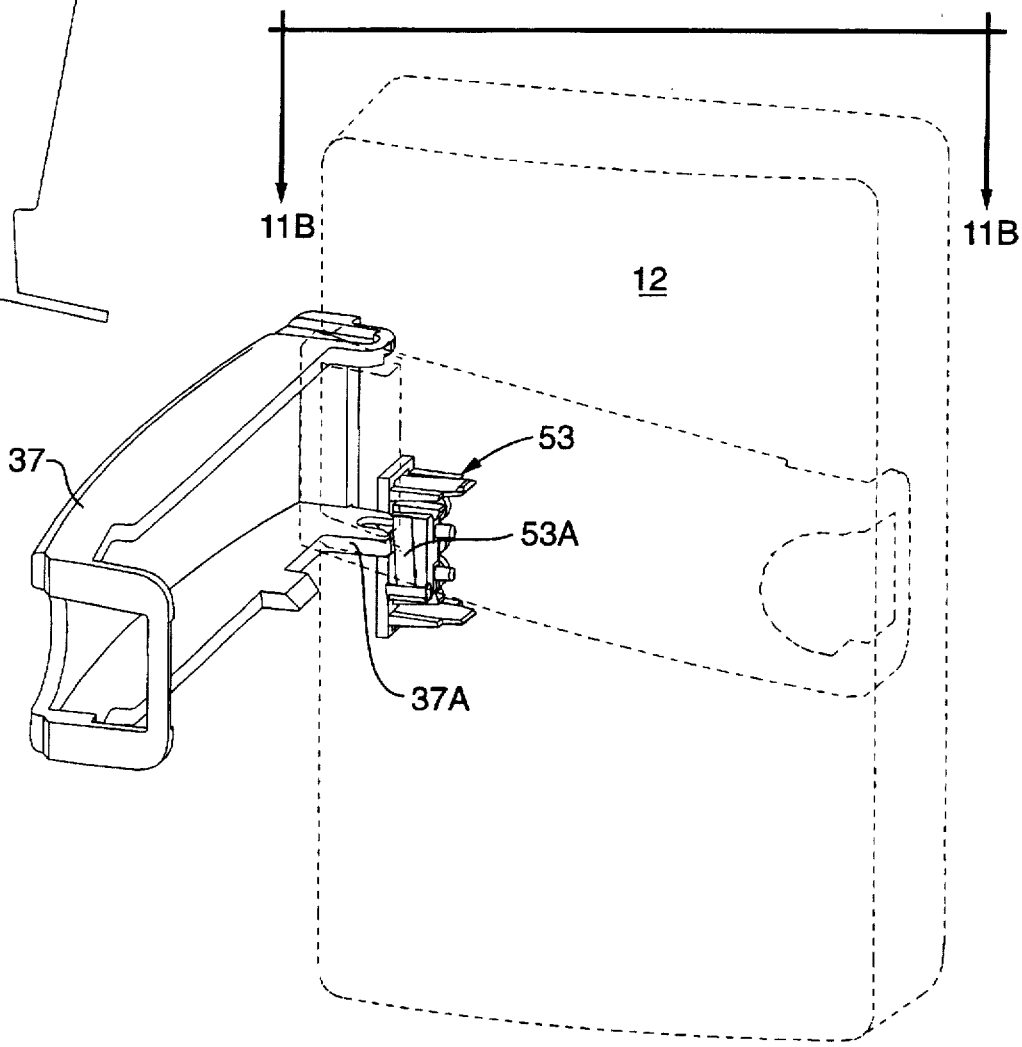
FIG. 11A is an isolated view of the pivotable shield protecting accidental activation of the pull bar of the pull station in FIGS. 2–5, with the shield pivoted open to illustrate its activation of one of the microswitches in FIG. 6 for controlling an optional feature.

FIGS. 11A and 11B illustrate the coupling between the microswitch assembly 53 and the shield 37. In its open position as illustrated in FIGS. 11A and 11B, a finger 37A of the shield has been rotated about a pivot axis 37B of the shield 37B to a position that is clear of a reed 53A of the microswitch assembly 53. In its closed position indicated in phantom in FIGS. 11A and 11B, the finger 37A draws into contact with the reed 53A, which moves the switch contact from pole 103 to pole 137 (FIG. 6).

Figure 12:
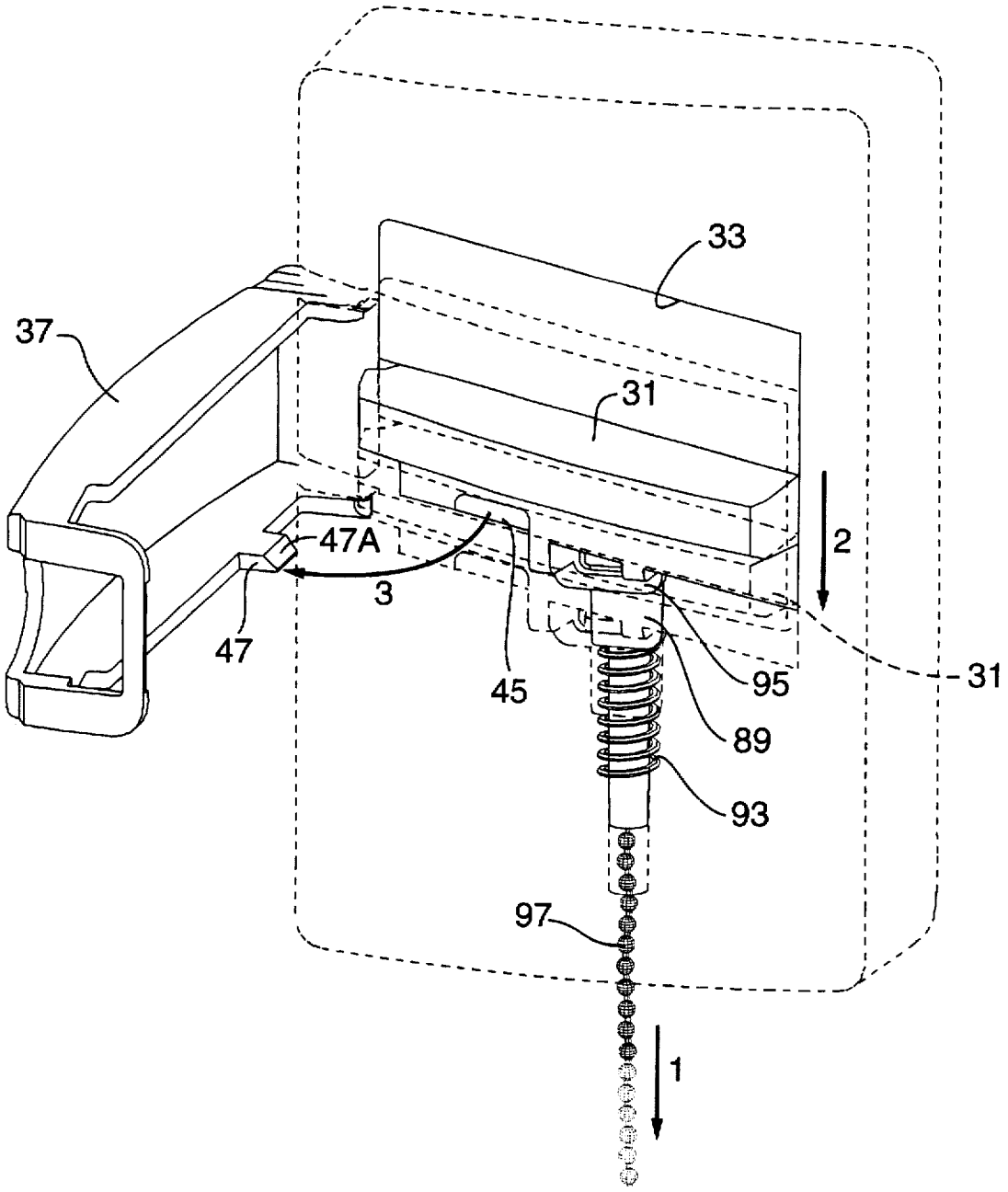
FIG. 12 is an isolated view of the pull bar shield and an optional assembly incorporated into the pull station that hooks a lanyard to the pull bar for actuating the pull station from below.

FIG. 12 illustrates the response of the coupling between the notch 45 in the plate 73 and the wedge 47 in the shield 37 when the lanyard 89 is pulled downwardly as indicated by the direction of arrow 1 in FIG. 12. When the lanyard 89 is pulled downwardly, the coupling between the lanyard and the plate 73 (i.e., the outrigger 95 and the lip 89A) causes the plate and the pull bar 31 to also move downwardly as indicated by the direction of arrow 2 in FIG. 12. As the plate 73 moves downwardly, the notch 45 engages the beveled surface 47A of the wedge. The coupling between the notch 45 and the wedge 47 at the bevel 47A causes the downward force applied to the plate 73 and the pull bar 31 by the pulling force on the lanyard 89 to be translated to a lateral force that kicks out the shield 37 as indicated by the direction of arrow 3 in FIG. 12.

Figures 13A, 13B, 13C, 13D, 13E, 13F:
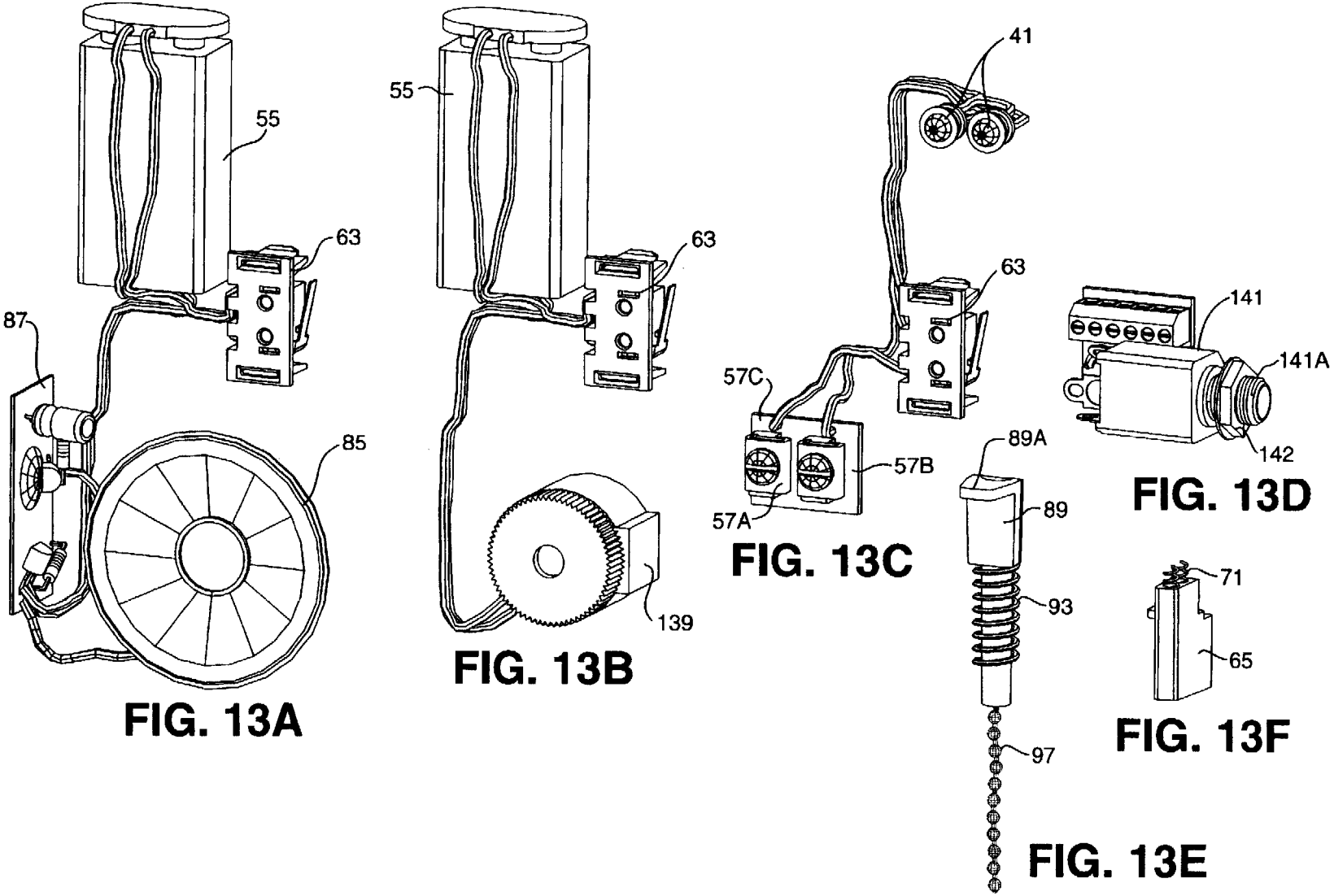
FIGS. 13A–13F are each an isolated perspective view of one of the modules for optional features of the pull station of FIGS. 2–5 that can either be added to the station during assembly or retrofitted thereafter.

FIG. 13 illustrates in isolation each of six optional modules for the pull station 12 in keeping with the invention. FIG. 13A illustrates the voice module comprising the microswitch assembly 63, the speaker 85, the printed circuit board 87 and the battery 55.

Alternatively, the microswitch assembly for the module could be the microswitch assembly 53 or 101, depending on the particular configuration of optional features incorporated into the pull station 12 as discussed in greater detail hereinafter in connection with FIGS. 14A–14H. The optional module illustrated in FIG. 13B provides a piezoelectric buzzer 139 for mating to the inside of the cover 35(FRONT) at the area of the grill 43. Like the voice module of FIG. 13A, the module of FIG. 13B includes the microswitch assembly 63 and the battery 55. Also like the module of FIG.

13a, the module of FIG. 13B can incorporate any one of the microswitch assemblies 53, 63 or 101. A third optional module that incorporates a microswitch is illustrated in FIG. 13C. This module includes the red and green LEDs 41 described above. These LEDs 41 are controlled by a microswitch assembly 63 or, alternatively, 53 or 101. Power is provided to the LEDs 41 by way of terminals 57A and 57B mounted to substrate 57C. FIGS. 13E and 13F illustrate in isolation the lanyard 89 and the follower 65, respectively. Each of these two modules is formed from the same plastic as used for the housing 35 and they are made using the same molding techniques.

In accordance with another aspect of the invention, a fireman's jack 141 as illustrated in FIG. 13D is incorporated into the pull station 12. The fireman's jack 141 receives a handset and couples the handset into an emergency voice communication network in a manner that is well-known in the art of emergency voice communication systems. In keeping with the modular design of the pull station 12, a nose 141A of the fireman's jack 141 is received through a hole in the side of the cover 35(FRONT). Although not shown in the cover 35(FRONT) of the illustrated embodiment, the cover may include a "knock-out" section for creating the hole necessary to receive the nose 141A of the fireman's jack 141. In a conventional manner, the fireman's jack is retained in the hole by way of a nut 142 that is secured over a threaded surface of the nose 141A. As those skilled in the art will appreciate, the fireman's jack 141 provides a port to a voice line 144 of an emergency voice system that a fireman may employ to communicate to a supervisor positioned at the control panel 15 as illustrated in FIG. 1A.

With the various optional modules available for incorporation into the pull station 12 as described above, a number of different embodiments of the station can be realized. Some of these different embodiments employing different configurations of the microswitch assemblies are illustrated in FIGS. 14A through 14H. In each of the illustrations in FIGS. 14A through 14H, a common convention is employed in order to represent the motion of the plunger 67 as it activates the microswitch assembly 69 and the motion of the shield 37 as it swings open and activates the microswitch assembly 53. Specifically, in the embodiments of FIGS. 14A through 14C, the plunger 67 is represented as moving from a position 1 shown by a solid rectangle to a position 2, which is illustrated by a rectangle of dashed lines. In the embodiments of FIGS. 14D–14H, the plunger 67 moves through three positions as indicated by the three rectangles labeled 1, 2 and 3. The pull stations of FIGS. 14D–14H include the follower 65, which introduces an intermediate position for the plunger 67 as illustrated in the sequence of FIGS. 9A–9E. Likewise, the embodiments of FIGS. 14D, 14C, 14G and 14H illustrate two rectangles labeled A and B, which represent movement of the shield 37 from a closed position (rectangle A) to an open position (rectangle B).

Figure 14A:
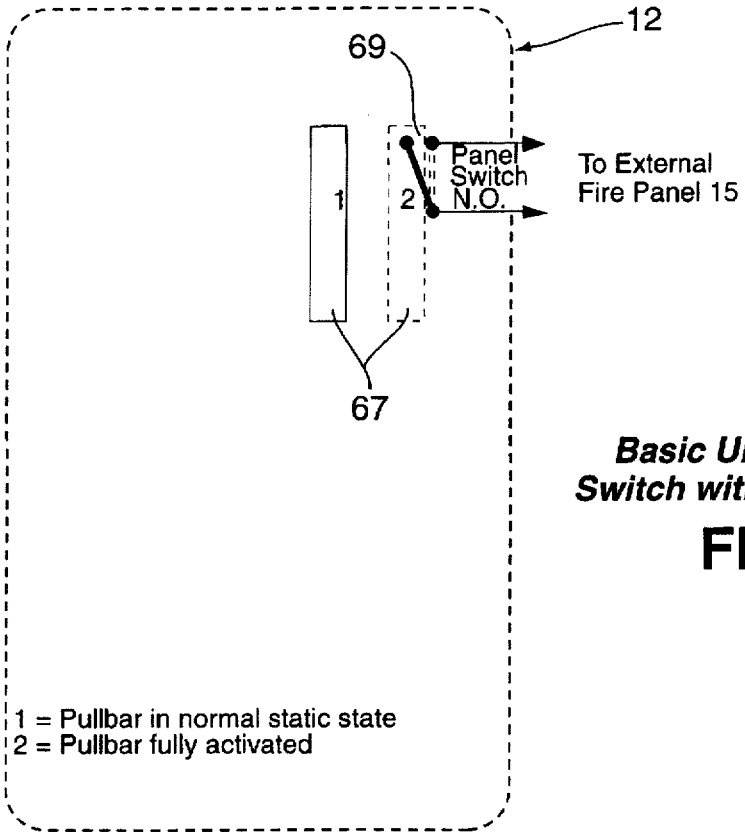
FIGS. 14A–14H are each a schematic diagram of one of the alternative embodiments of the pull station, where the schematic of FIG. 14A is for a basic pull station without any options and the remaining schematics are of the basic pull station incorporating various ones of the optional features of FIGS. 13A–13F.

FIG. 14A illustrates the basic configuration of the pull station 12 wherein the pull bar 31 moves the plunger 67 from position 1 to position 2, which activates the microswitch assembly 69.

Figure 14B:
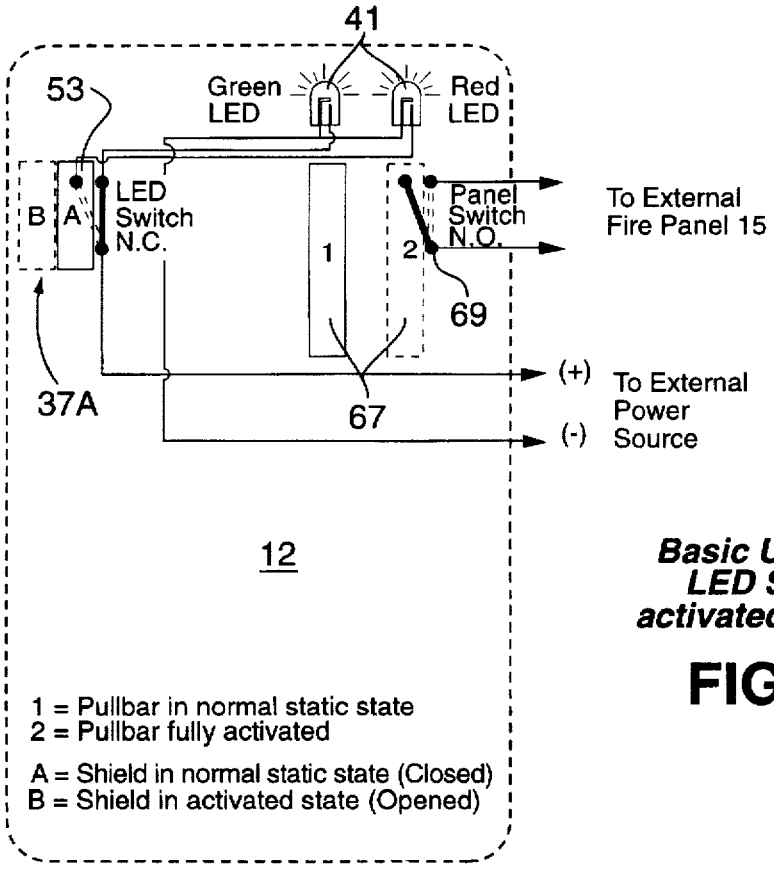

In FIG. 14B, the optional module illustrated in FIG. 13C has been added. This optional module includes the addition of microswitch assembly 53 and the green and red LEDs 41 as illustrated. In operation, the shield 37 is opened, which draws the finger 37A away from the reed 53A of the microswitch assembly 53. In keeping with the convention of the illustrations in FIGS. 14A–14H, solid rectangle A in FIG. 14B indicates the initial position of the finger 37A—i.e., when the shield is closed. When the shield opens, the finger moves to a position away from the microswitch 53, which is represented by the rectangle B. After the shield 37 has been opened and the microswitch assembly 53 activated to turn on the red LED 41, the pull bar 31 is pulled downwardly. As the pull bar 31 is pulled downwardly, the plunger 67 moves from its initial position represented by the rectangle 1 to the position represented by rectangle 2. As in the basic unit of FIG. 14A, the plunger activates the microswitch assembly 69 in position 2 of FIG. 14B.

Figure 14C:
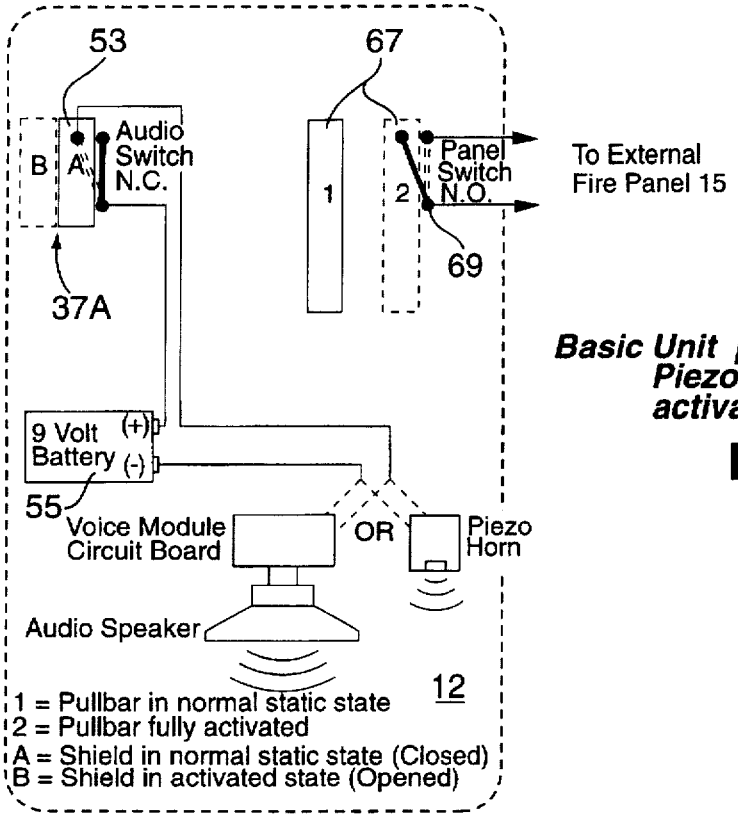

As an alternative to activating the LEDs 41 as illustrated in the embodiment of FIG. 14B, the embodiment of FIG. 14C substitutes the voice module for activation by the microswitch assembly 53 in response to opening the shield 37.

Figure 14D:
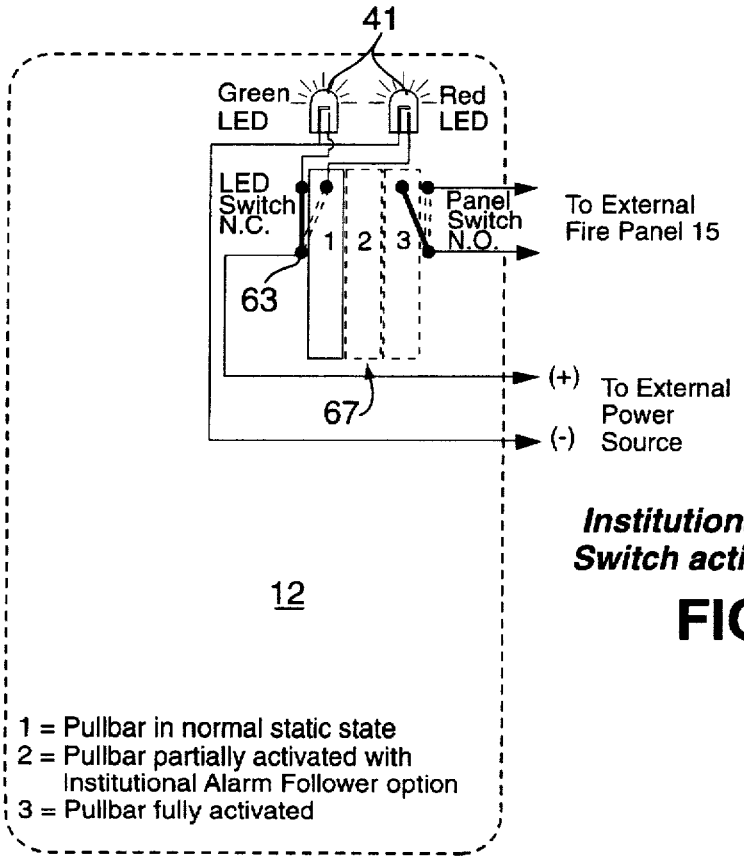

In the embodiment in FIG. 14D, the follower 65 has been added to the pull station 12. Thus, the plunger 67 now moves through three positions identified by rectangles 1, 2 and 3. When the pull bar 31 is moved from its armed position to its activated position, the plunger 67 moves from position 1 to position 2, which activates the microswitch assembly 63. Rotation of the lock 39 frees the plunger to move from position 2 to position 3, which activates the microswitch assembly 69. In the embodiment of FIG. 14D, the microswitch assembly 63 controls the LEDs 41, which receive power from an external source.

Figure 14E:
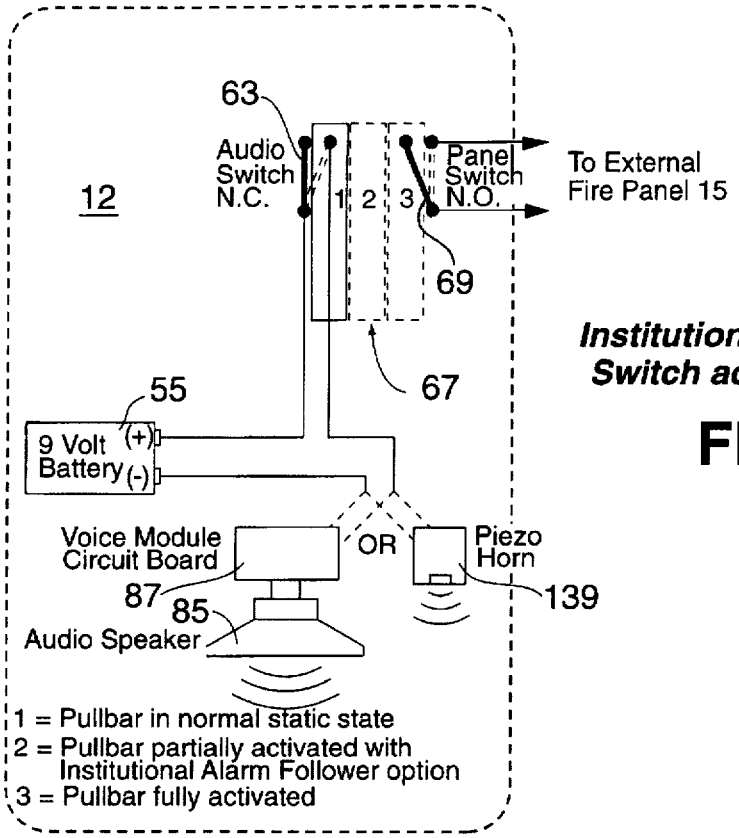

In the embodiment of FIG. 14E, the pull station 12 includes the follower 65 and the microswitch assembly 63 activates the voice module, which receives power from a 9 volt battery 55.

Figure 14F:
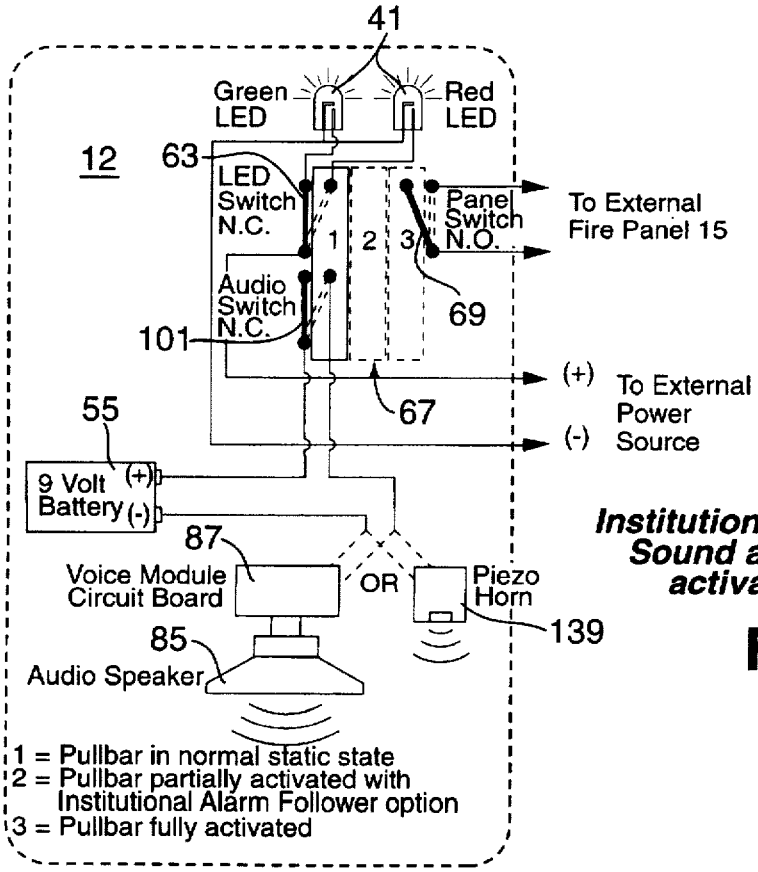

In the embodiment in FIG. 14F, the microswitch assembly 101 is stacked on the microswitch assembly 63 as illustrated in FIG. 8. Like the embodiments of the pull station 12 in FIGS. 14D and 14E, the pull station of FIG. 14F includes the follower 65 so that the plunger 67 moves through three positions as indicated by the rectangles 1, 2 and 3. In this embodiment of the pull station 12, the microswitch assembly 63 controls the LEDs 41 and the microswitch assembly 101 controls the voice module of FIG. 13A or, alternatively, the piezoelectric buzzer 139 of FIG. 13B.

Figure 14G:
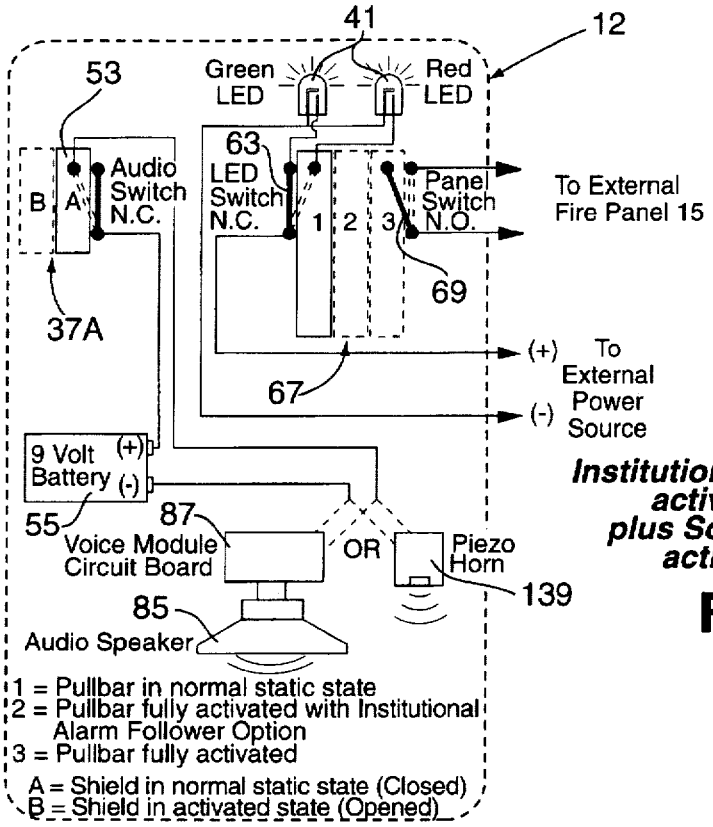

FIG. 14G illustrates an embodiment of the pull station 12 that includes the follower 65 and microswitch assemblies 53, 63 and 69. The microswitch assembly 53 controls either the voice module of FIG. 13A or the buzzer module of FIG. 13B, which are powered by the 9 volt battery 55. The microswitch assembly 63 controls the LEDs 41 and provides power to them from an external source.

Figure 14H:
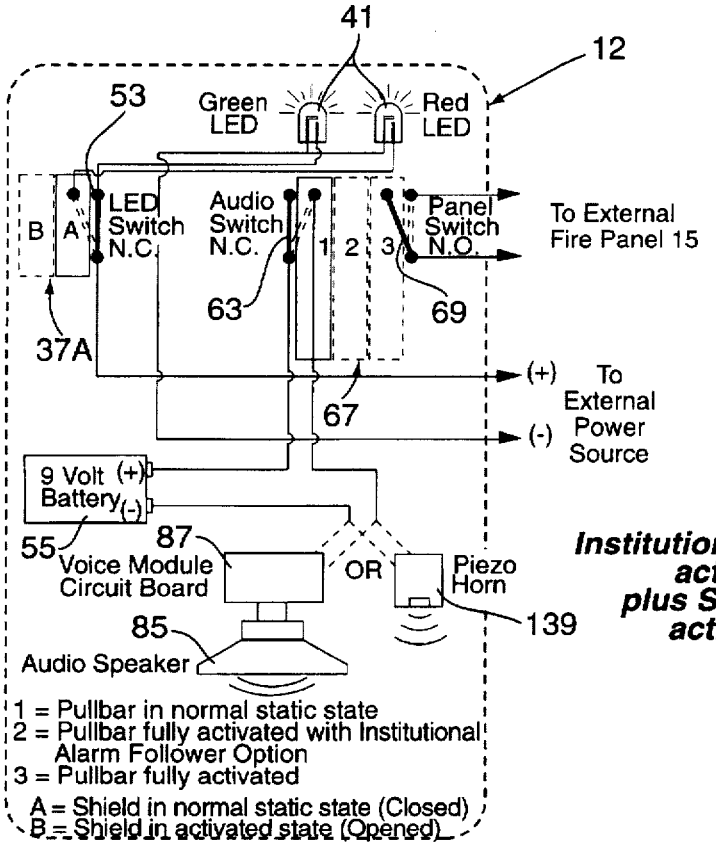

Finally, the embodiment of the pull station in FIG. 14H reverses the connections of the microswitch assemblies 53 and 63 with respect to the embodiment in FIG. 14G. Specifically, the microswitch assembly 53 controls the LEDs 41 and the microswitch assembly 63 controls either the voice module of FIG. 13A or the buzzer module of FIG. 13B.

The invention has been described in connection with a preferred embodiment for implementing the modular construction of the invention. Other embodiments for implementing a modular construction in which modules of optional features can be selectively added to a basic unit are also within the scope of the invention as defined by the claims set forth below.

We claim as our invention:

1. A pull station for activating an alarm system, the station comprising: a manually actuated assembly having armed and activated positions for opening and closing a switch in the alarm system; a housing for the assembly and the switch that allows the assembly to be manually accessed and actuated; and, a key-actuated mechanism accessible from an external surface of the housing for resetting the switch and returning the assembly from the activated position to the armed position without opening the housing and exposing the switch.

2. The pull station of claim 1 including a safety shield pivotably mounted to the housing between closed and opened positions, where the shield in the closed position prevents the assembly from moving to its activated position.

3. The pull station of claim 2 including a second switch controlled by the pivoting of the safety shield.

4. The pull station of claim 2 including a lanyard extending from the housing and coupled to the assembly; and, a coupling between the assembly and the shield that kicks out the shield when the assembly moves into its activated position in response to pulling the lanyard.

5. The pull station of claim 1 wherein the housing is a clam-shell construction having a front cover and a back plate, the front cover having a port for manually accessing a pull bar of the assembly and the back plate having (1) a substantially flat surface for mounting to a surface and (2) a port for communicating wiring to and from the fire alarm system.

6. The pull station of claim 1 wherein the assembly includes a pull bar movable between first and second positions and a follower for following the movement of the pull bar from its first position to its second position and thereby inhibiting activation of the first switch; a release apparatus accessible from an exterior surface of the housing for moving the follower when the pull bar is in its second position, thereby freeing the assembly to move to its activated position, which activates the first switch.

7. The pull station of claim 6 including means for retaining the pull bar in its second position and a device responsive to the mechanism accessible from the external surface for releasing the pull bar from its second position.

8. The pull station of claim 7 including a spring for biasing the pull bar in its first position.

9. The pull station of claim 1 wherein the assembly includes (1) a pull bar movable between first and second positions in a first direction, (2) a switch actuator coupled to the pull bar and mounted in the housing for movement in a second direction transverse to the first direction and in response to the movement of the pull bar, the actuator including an arm for contacting and closing the first switch and (3) a coupling between the pull bar and the switch actuator for translating the motion of the pull bar to the actuator.

10. The pull station of claim 9 wherein the switch actuator includes a spring-loaded plunger fixedly mounted to the housing and biased against a bearing surface of the pull bar when the pull bar is in its first position and disengaged from the bearing surface when the pull bar is in its second position such that the plunger is released from a tension derived from the bias against the bearing surface, causing the plunger to move the arm of the actuator into contact with the first switch, thereby closing the switch.

11. The pull station of claim 1 wherein the first switch includes a module for mating with a receptacle on an interior surface of the housing.

12. The pull station of claim 1 including a lanyard extending from the housing and coupled to the assembly.

13. A pull station for activating an alarm system, the station comprising: a manually actuated assembly having armed and activated positions for opening and closing a switch in the alarm system; a housing for the assembly and the switch that allows the assembly to be manually accessed and actuated; a module for an optional feature of the pull station; a receptacle for mounting the module within the housing to be in registration with movable parts of the station that control activation of the optional feature; and, the receptacle including a portion that cooperates with a complementary portion of the module to retain the module mounted to the receptacle and in registration with the moveable parts.

14. The pull station of claim 13 wherein the movable parts include movable parts of the manually actuated assembly.

15. The pull station of claim 14 wherein the movable parts of the station include a shield pivotably mounted to the housing for protecting the manually actuated assembly from accidental activation.

16. The pull station of claim 13 wherein the module includes a switch.

17. The pull station of claim 13 wherein the complementary portions of the receptacle and the module form fasteners that provide a snap-fit engagement between the receptacle and the module.

18. The pull station of claim 13 wherein the module includes a terminal for receiving wiring external to the housing.

19. The pull station of claim 13 wherein the module includes a printed circuit board.

20. The pull station of claim 13 wherein the module includes a follower slidably mounted in the receptacle to form part of the manually actuated assembly that provides an intermediate position of the assembly between the armed and activated positions.

21. The pull station of claim 13 where in the module includes a lanyard mounted in the receptacle for slidable movement and coupled to the manually actuated assembly.

22. The pull station of claim 13 wherein the module includes a sound generating device.

23. The pull station of claim 13 wherein the module includes a battery.

24. The pull station of claim 13 including a fireman's jack mounted to the housing of the pull station for connecting a hand set to an emergency voice communication system.

25. An emergency alarm system comprising a pull station having a manually movable assembly for sequentially actuating first and second switches; a first alarm circuit including the first switch for generating an alarm signal in an area local to the pull station when the first switch is actuated; a second alarm circuit including the second switch for generating an alarm signal extending beyond the local area when the second switch is actuated, and, a secured actuator for actuating the second switch only in response to input from an authorized user of the pull station.

26. The alarm system of claim 25 wherein the movable assembly includes a shield pivotably mounted to a housing of the pull station for actuating the first switch.

27. The alarm system of claim 25 wherein the first alarm circuit includes a sound generator within a housing of the pull station.

28. The alarm system of claim 27 wherein the sound generator is a voice synthesizer for generating a voice message.

29. The alarm system of claim 27 wherein the sound generator is a piezoelectric device.

30. The alarm system of claim 25 wherein the first alarm circuit includes a light emitting device mounted to a housing of the pull station.

31. A pull station in an alarming system, the station comprising: an assembly movable between armed and activated positions for controlling the opening and closing of a switch in the alarm system; an apparatus for returning the assembly from its activated position to its armed position without opening a housing for the assembly; and, means for securing the apparatus so that only authorized personnel can return the assembly to its armed position after it has been moved to its activated position while the switch is maintained substantially inaccessible to manual manipulation.

32. The pull station of claim 31 wherein the apparatus is a lock accessible from a front cover of the housing and the securing means is a key for the lock.

33. The pull station of claim 32 including a follower that prevents actuation of the switch by the assembly when it is moved to its activated position and a coupling responsive to the apparatus for moving the follower and freeing the assembly to actuate the switch.

34. A pull station for activating an alarm system, the station comprising: a manually actuated assembly having armed and activated positions for opening and closing a first switch in the alarm system; a housing for the assembly and the first switch that includes an opening for manually accessing the assembly; a shield pivotally mounted to the housing for covering the opening when the shield is in a closed position; a second switch contained within the housing and coupled to the shield for actuation when the shield is pivoted to an open position that reveals the opening in the housing and allows access to the manually actuated assembly; and a sensory feedback circuit contained within the housing responsive to the actuation of the second switch by the shield for generating sensory feedback local to the pull station.

35. The pull station of claim 34 wherein the manually actuated assembly includes a plunger mounted within the housing for consecutive movement through first, second and third positions, wherein the first position is the armed position of the assembly, the third position is the activated position of the assembly and the second position is an intermediate position that activates a third switch contained within the housing.

36. The pull station of claim 35 wherein the third switch controls an alarm circuit.

37. The pull station of claim 34 wherein the housing includes a front cover and a back plate connected by a pivot coupling and fastened together by a fastener; and, the back plate having a substantially flat exterior surface and at least one port for communicating wiring into a terminal assembly within the housing.

* * * * *